US006527361B1

(12) United States Patent
Gotoh et al.

(10) Patent No.: US 6,527,361 B1
(45) **Date of Patent: *Mar. 4, 2003**

(54) REFRESHING AND RECOVERING INK DISCHARGE IN A MULTI-COLOR INK JET RECORDING APPARATUS

(75) Inventors: Fumihiro Gotoh, Kawasaki (JP); Hiromitsu Hirabayashi, Yokohama (JP); Shigeyasu Nagoshi, Kawasaki (JP); Noribumi Koitabashi, Yokohama (JP); Hitoshi Sugimoto, Yokohama (JP); Miyuki Fujita, Tokyo (JP); Hitoshi Nishikori, Kawasaki (JP); Masaya Uetuki, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/250,678

(22) Filed: May 26, 1994

(30) Foreign Application Priority Data

May 26, 1993 (JP) ..... 5-124237
May 27, 1993 (JP) ..... 5-126356

(51) Int. Cl.[7] ..... B41J 2/165
(52) U.S. Cl. ..... 347/30; 347/24
(58) Field of Search ..... 347/23, 24, 30, 347/29

(56) References Cited

U.S. PATENT DOCUMENTS 4,558,332 A * 12/1985 Takahashi ..... 347/23 X
4,692,777 A * 9/1987 Hasumi ..... 347/23
5,128,690 A 7/1992 Nozawa ..... 347/30
5,172,140 A 12/1992 Hirabayashi et al. ..... 347/36
5,182,582 A 1/1993 Okamura ..... 347/33
5,266,974 A 11/1993 Koitabashi et al. ..... 347/33
5,495,271 A * 2/1996 Koitabashi et al. ..... 347/23

FOREIGN PATENT DOCUMENTS

EP 0 398 347 A2 * 11/1990 ..... B41J/2/165
JP 63-252748 A * 10/1988 ..... 347/23
JP 2202453 * 8/1990 ..... 347/24
JP 04255360 9/1992

* cited by examiner

*Primary Examiner*—Judy Nguyen
(74) *Attorney, Agent, or Firm*—Fitzpatrick, Cella, Harper & Scinto

(57) ABSTRACT

This ink jet recording apparatus makes it possible to reduce the requisite number of times that preliminary ejection is performed for the purpose of ejection recovery through suction, which must be effected to such a degree as to make color mixing on the recording paper sufficiently inconspicuous. With a plurality of recording heads using inks of different lightnesses, ejection recovery is performed successively on the recording heads in accordance with the descending order of ink lightness. In addition, the number of preliminary ejections after ejection recovery to be performed on the next recording head is also controlled, thereby attaining a still greater effect. In a method aspect, the present invention includes an initial discharge step for discharging ink from a recording head, interrupting the discharge of ink for an appropriate period set in accordance with the ink lightness, and discharging ink again from the discharge ports of the recording head after the interruption.

17 Claims, 24 Drawing Sheets

(EXAMPLE 1)

(COMPARATIVE EXAMPLE 2)

(EXAMPLE 2)

REFRESHING AND RECOVERING INK DISCHARGE IN A MULTI-COLOR INK JET RECORDING APPARATUS

BACKGROUND OF THE INVENTION

1. Field of the Invention

The present invention relates to ink jet recording on a recording medium, such as paper or cloth, and, in particular, to refreshing and recovering ink discharge in an ink jet recording apparatus.

2. Description of the Related Art

Recording apparatuses, such as printers, copying machines and facsimile apparatuses, record images consisting of dot patterns on recording media, such as paper, cloth or thin plastic films, on the basis of image information.

Depending on the recording method, such recording apparatuses can be classified into ink jet type apparatuses, wire dot type apparatuses, thermal type apparatuses, laser beam type apparatuses, etc. An ink jet apparatus records by ejecting ink (recording liquid) from ejection ports of the recording head so as to cause the ink to adhere to the recording medium.

Recently, various types of recording apparatuses have come into use. The most useful of such apparatuses comply with various requirements, such as providing high-speed, high-resolution, high image quality and low-noise recording.

With that in mind, ink jet type recording systems have been attracting attention because they are very quiet. In particular, an ink jet type recording system utilizing bubble jetting of liquid (hereinafter referred to as "BJ") by heating has been attracting attention as a high quality and inexpensive high-speed printing method readily allowing an increase in recording density, being very quiet and readily enabling color printing.

Further, because they increase recording speed, recording apparatuses having a recording head with a plurality of recording elements (hereinafter referred to as a "multi head") have come into general use. Further, to cope with various requirements of color recording, a recording apparatus having a plurality of such multi heads has been developed.

FIGS. 6(*a*) and 6(*b*) are perspective views of an example of a conventional ink jet recording head used in a typical ink jet recording apparatus. As shown in these drawings, this ink jet recording head includes: an orifice plate 21*c* having ink discharge ports (orifices) 21*b;* a grooved top plate 23 having grooves 10 forming ink passages (nozzles) communicating with the orifices and a common liquid chamber 13 forming an ink accumulator; and a heater board 16 having heat generators 22 provided in the ink passages and consisting of electro-thermal converters serving as heat energy generating elements for generating heat energy to be utilized in creating bubbles and ejecting ink from the orifices. Numeral 21*a* indicates an ink supply port leading to the common liquid chamber 13 and the ink passages.

An ink jet apparatus equipped with such an ink jet head has a cap used in a suction recovery operation, in which ink is sucked through the discharge ports in order to eliminate defective ejections. The cap also serves to prevent ink from drying in the discharge ports. As ink is being repeatedly ejected during recording, some bubbles in the ink passages may fail to disappear. If too many bubbles remain in the ink passage, or if the volume of the bubbles becomes so large as to block the nozzle outlets, it will become impossible to ensure passage of ink through the ink supply passages. The suction recovery operation mentioned above is often performed for the purpose of removing such bubbles.

An ink jet recording apparatus having a plurality of recording head, for example, a color ink jet recording apparatus having recording heads respectively corresponding to four ink colors, black (Bk), cyan (C), magenta (M) and yellow (Y), is provided, for example, with four suction/shutdown caps and four suction pumps respectively connected thereto, or a single large suction pump connected to all four caps. In such an ink jet recording apparatus, all of the different colored inks may be sucked simultaneously. In a type of ink jet recording apparatus which has a single suction pump, a single cap exclusively used for sucking, and shutdown caps for the recording heads, the suction of the inks in the recording heads is successively effected from head to head.

Conventionally, when performing a suction recovery operation, a cylinder pump has been used, which pump utilizes, instead of the gravitational force of the ink, piston movements, thus enabling the ink to be reliably recovered. This cylinder pump utilizes the surface of its piston when opening or closing a hole through which waste ink is recovered from an ink receiving member such as a cap, and causes the waste ink to be moved, by way of a waste ink transfer passage provided on the piston rod, to a waste ink container having a larger capacity for storing ink than the ink receiving member.

A color ink jet recording apparatus of the type in which a plurality of recording heads are successively sucked by using a single suction cap and a single suction pump, has a problem in that inks of different colors can be mixed in the suction cap when sucked therein, so that such mixed ink can be drawn into a nozzle, resulting in a mixed colored ink being printed on the recording paper.

To copy with this problem, preliminary ink ejection is performed in order to drain any mixed ink in the nozzle. However, to completely drain the mixed ink in the nozzle, the preliminary ejection has to be performed a number of times, which uses excessive ink and takes a long time.

Further, it is known that some of the solvent contained in the ink may evaporate from the ends of the nozzles, resulting in density inconsistencies at the start of the printing. To solve this problem, ink discharge by suction or pressurization is performed when printing is to be performed for the first time after a long shutdown period in order that such density inconsistencies may be mitigated. Further, an ink refreshing operation, such as preliminary ink ejection, can also be performed at a position and timing which do not interfere with the recording.

Further, wiping is performed in order to completely remove any ink remaining on the ejection face of the head after completion of an ejection recovery operation based on suction and pressurization and to remove any ink mist that has settled on the ejection face during and after printing. During this wiping operation, which is performed with a single wiper, some of the ink on the wiper can be transferred to the discharge port and mixed with the ink therein. To remove the resulting mixed ink, it is necessary to perform a discharge operation as in the case when preventing density inconsistencies. Thus, when a single wiping mechanism is used for a head using inks of different colors, inks of different degrees of lightness may be mixed with each other, making it necessary to perform an additional discharge operation in order to eliminate density inconsistencies caused by the recovery operation.

Such additional discharge can be effected, for example, by always performing a recovery operation, such as preliminary ink ejection or suction, whenever printing is performed, independently of how printing has been performed by the apparatus up to that moment. Alteratively, the recording apparatus may be provided with a timer for counting non-printing periods including power-off periods. In that case, a recovery operation is conducted whenever the time counted by the timer exceeds a predetermined length of time. Further, it is also possible to divide the time to be counted by the timer. That is, when the shutdown period has been short and a relatively slight evaporation on ink is expected, the recovery operation consists of preliminary ejection only. When the shutdown period has been long and the density inconsistencies cannot be easily eliminated by such ejection alone, ink discharge is effected by suction and pressurization. When the timer is used in this way, it is possible to attain a reduction in the amount of ink consumed since only preliminary ejection, which consumes a relatively small amount of ink, is conducted in the case where a slight amount of ink has been evaporated.

However, in a case when the ink in the head is extremely concentrated, a great amount of ink has to be consumed in order to remove such concentrated ink and to mitigate density inconsistencies, even when the above-described conventional ejection recovery techniques are adopted. Similarly, when preliminary ink discharge is performed for the purpose of preventing color mixing, a large amount of ink must be consumed for purposes other than printing before an amount of ink large enough to prevent density inconsistencies can be discharged.

According to a conventional method, to curtail the amount of waste ink, a preliminary discharge operation is interrupted simultaneously for all of the heads. That is, according to this conventional method, a temporary interruption of ink discharge is effected after a first stage of ink discharge, thereby enabling different portions of ink in the head to be uniformly mixed by eddy currents generated as a result of the ink flow in the head during preliminary discharge. After this, a second stage of ink discharge is executed, thereby eliminating density inconsistencies more effectively.

If, in the above conventional method, the discharging of ink is resumed before the ink concentrated through evaporation of solvent has been sufficiently mixed with newly supplied ink, a sufficient cleaning effect cannot be obtained, and a reduction in the amount of ink discharged cannot be achieved. Further, if the first stage of ink discharge is too long, a lot of time is required to perform the recovery operation.

One aspect of the present invention proceeds from the discovery that the optimum ink discharge interruption period varies for different heads, inks, etc., particularly in a color recording apparatus. Whether density inconsistencies in a color recording apparatus are conspicuous or not depends upon the lightness of the ink. For example, in the case of a recording apparatus using four colors, yellow, cyan, magenta and black, a relatively long ink discharge interruption period is necessary for yellow since density inconsistencies are liable to be conspicuous in this color. In contrast, black requires a very short interruption period since density inconsistencies in this color are not very conspicuous due to its low lightness.

SUMMARY OF THE INVENTION

A general object of the present invention is to provide an ink jet recording apparatus in which the length of a recovery operation can be reduced, so that the amount of waste ink and the time required for the recovery operation are reduced, thereby attaining a reduction in operating cost and an increase in throughput.

In accordance with one aspect of the present invention, an ink jet recording apparatus having a plurality of recording heads for respectively ejecting through discharge ports a plurality of inks of different lightness and a recovery mechanism for performing a recovery operation on a selected recording head by sucking ink through the discharge ports of the recording head comprises scanning means for moving each of the plurality of recording heads to a position facing the recovery mechanism, selection means for selecting one of the recording heads on which the recovery operation is to be performed, and recovery control means for performing the recovery operation successively on the plurality of recording heads in a descending order of ink lightness.

In accordance with another aspect of the present invention, an ink jet recording apparatus having a plurality of recording heads for respectively ejecting through discharge ports a plurality of kinds of inks and a recovery mechanism for performing a recovery operation on a selected recording head by sucking ink through the discharge ports of the recording head comprises scanning means for moving each of the plurality of recording heads to a position facing the recovery mechanism, ink ejection means for repeatedly ejecting ink from the discharge ports of a selected recording head, selection means for selecting one of the recording heads on which the recovery operation is to be performed, and ejection control means for controlling the number of times that ink is to be ejected from a selected recording head on which the recovery operation has been performed according to the kind of ink used by a preceding recording head on which the recovery operation has been performed.

In accordance with a still further aspect of the present invention, a recording head recovery method for an ink jet recording apparatus having a plurality of recording heads for respectively ejecting through discharge ports a plurality of inks of different lightness, a recovery mechanism for performing a recovery operation on a selected recording head by sucking ink through the discharge ports of the recording head and an ink ejection mechanism for repeatedly ejecting ink from the discharge ports of the recording heads comprises the steps of selecting a recording head on which the recovery operation is to be performed, performing the recovery operation on successive recording heads in order of descending ink lightness by bringing each of the plurality of recording heads successively to a position where they face the recovery mechanism, and ejecting ink from each recording head a number of times according to a preceding the recording head on which the recovery operation has been performed.

In accordance with a yet further aspect of the present invention an ink refreshing method for an ink jet recording apparatus having a plurality of recording heads for respectively ejecting inks of different lightness and an ink supply system for supplying the inks to the recording heads as the inks are ejected therefrom comprises the steps of initially discharging ink from discharge ports of a selected recording head, interrupting the initial discharge step for a predetermined period in accordance with the lightness of the ink discharged by the recording head, wherein the period is longer for inks of greater lightness, and subsequently discharging ink from the discharge ports of the recording head after the interruption.

In accordance with a still further aspect of the present invention, an ink refreshing method for a recording apparatus having a recording head for ejecting from discharge ports a given amount of ink and an ink supply system for supplying ink to the recording head as the ink is ejected therefrom comprises the steps of initially discharging ink from the discharge ports by applying energy to ink in the recording head or to the storage member or to the supply system, interrupting the ink discharge for an appropriate one of a plurality of periods set in accordance with an ascending order of the amount of ink ejected from the recording head, and subsequently discharging ink from the discharge ports after the interruption by applying energy to ink in the recording head or to the storage member or to the supply system.

DESCRIPTION OF THE PREFERRED EMBODIMENTS

Figure 6:
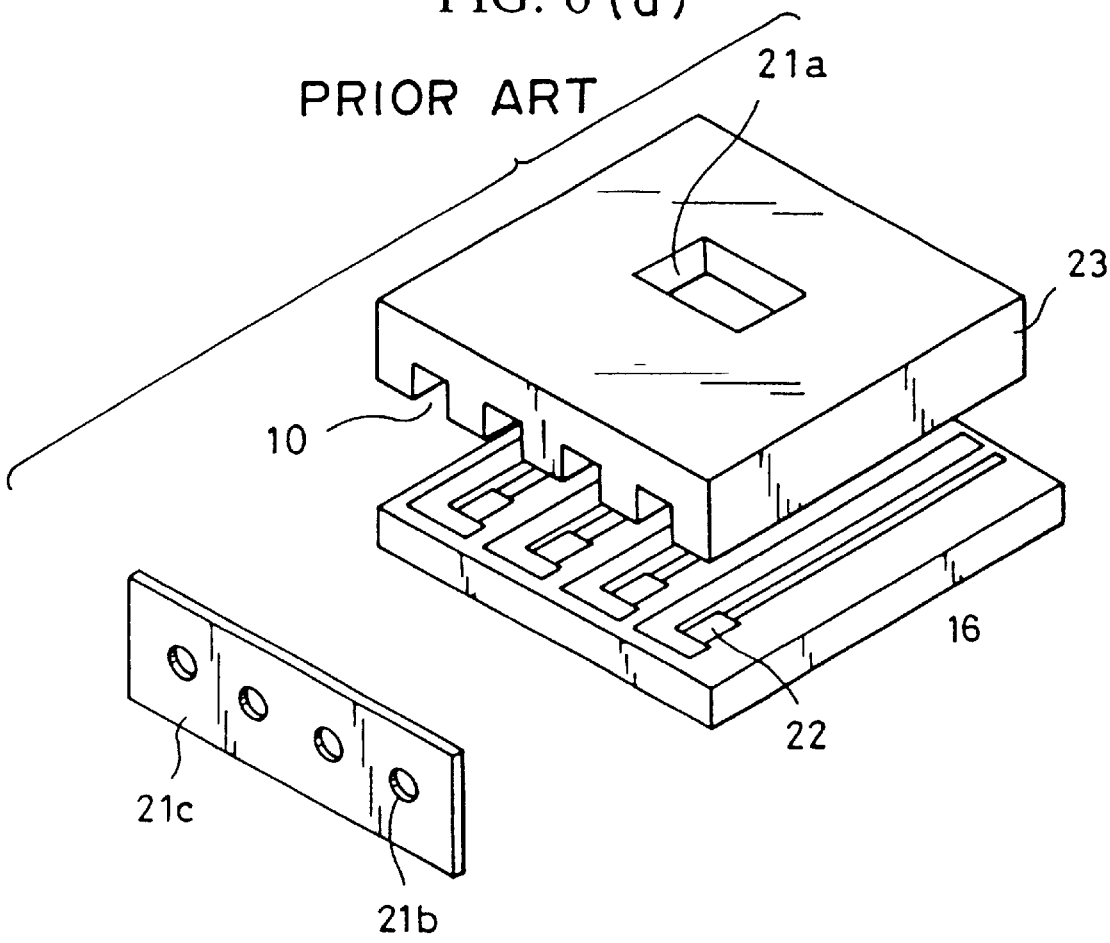
FIGS. 6(*a*) and 6(*b*) are perspective views of a conventional recording head.
Figure 6:
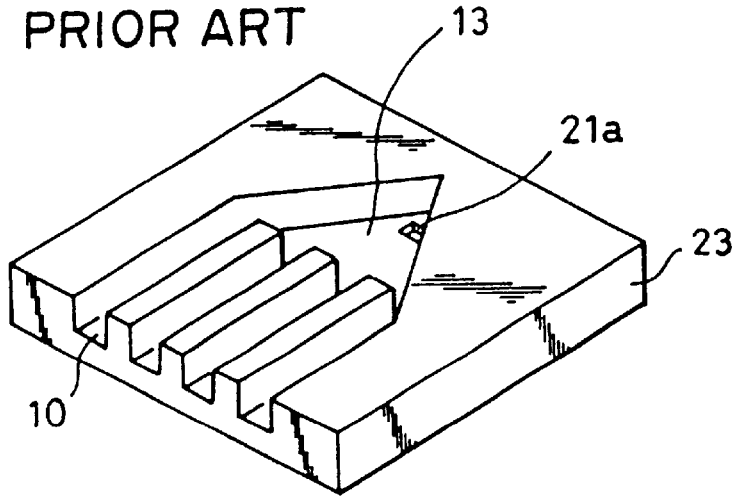
Figure 7:
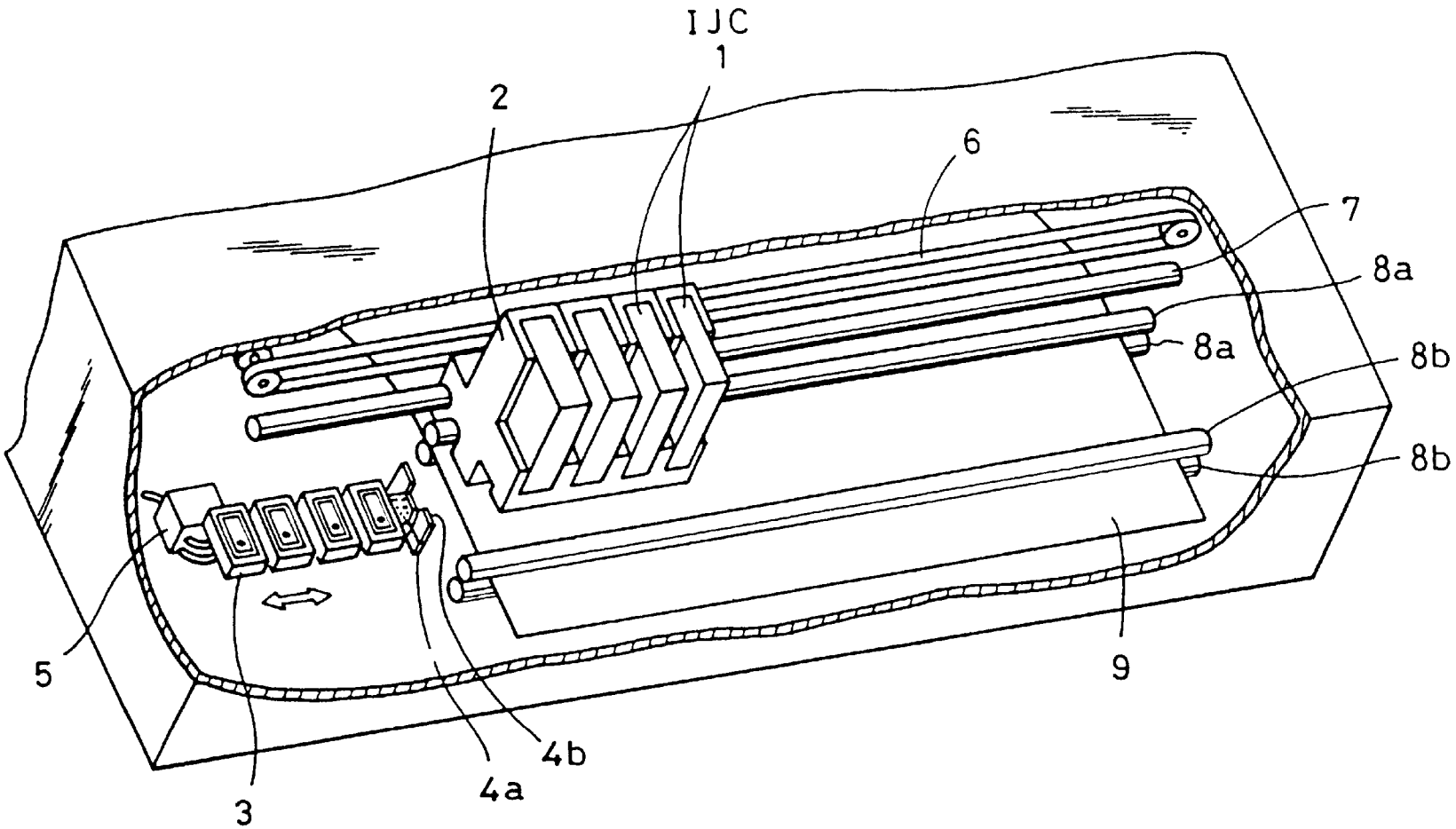
FIG. 7 PRIOR ART
FIG. 7 is a perspective view showing the construction of a conventional ink jet recording apparatus.
Figure 8:
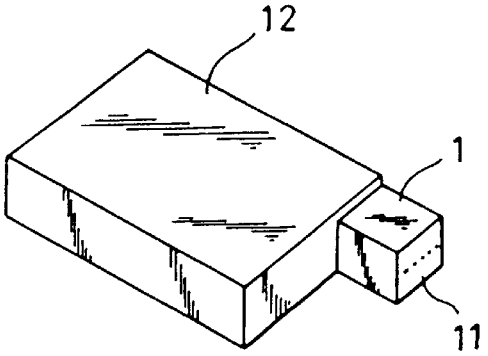
FIG. 8 PRIOR ART
FIG. 8 is a perspective view showing a conventional replaceable cartridge.

Embodiments of the present invention will now be described. FIG. 7 is a perspective view showing the construction of a conventional color ink jet recording apparatus having a plurality of recording heads 1 (IJH), and FIG. 8 is a perspective view of a conventional replaceable cartridge. In FIG. 7, IJC indicates cartridges containing inks of four colors, black (Bk), cyan (C), magenta (M) and yellow (Y), respectively. As shown in FIG. 8, an ink tank 12 and recording head 1 are formed into an integral unit constituting the replaceable cartridge (IJC). The recording head is constructed according to the principles discussed above in connection with FIG. 6. In FIG. 8, numeral 11 indicates a nozzle section for ejecting ink droplets. In FIG. 7, numeral 2 indicates a carriage (HC) through the intermediation of which the cartridges (IJC) are mounted on the printer body, and numeral 7 indicates a guide for scanning the carriage along a main-scanning direction.

Numerals 8*a* and 8*b* indicate platen rollers for scanning a printing medium 9 along a sub-scanning direction. In the carriage 2, a flexible cable (not shown) for supplying the recording heads 1 with signal pulses for driving, head temperature adjusting signals, etc., is connected to a printed circuit board (not shown) having an electric circuit for controlling the printer.

Next, the ejection recovery system of the above ink jet recording apparatus will be described. This recording apparatus has recording head recovery system units. Numeral 3 indicates cap units, which respectively correspond to the recording heads to perform capping thereon. A pump unit 5 performs ejection recovery on the recording heads by sucking ink therefrom when the cap units 3 are attached thereto. Numeral 4*a* indicates a cleaning blade, and numeral 4*b* indicates a member supporting the cleaning blade 4*a*. The blade configuration is not restricted to the one shown in the drawing. Other types of cleaning blades having a well-known configuration can be applied to this example.

The capping operation, the cleaning operation and the ejection recovery operation through the sucking of ink can be conducted as desired when the carriage HC is at the home position and the heads are at positions corresponding to the units for each operation, respectively. These operations can be performed with an appropriate timing in a well-known manner.

Figure 9:
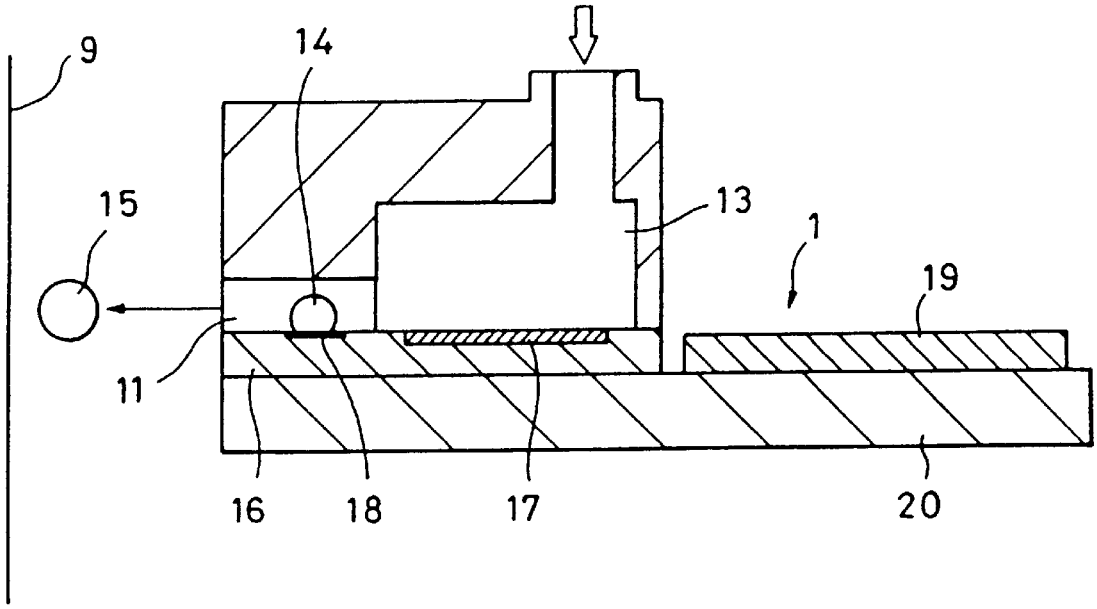
FIG. 9 PRIOR ART
FIG. 9 is a sectional view of a conventional recording head.

FIG. 9 is a sectional view showing the conventional recording head 1 in detail. The recording head 1 includes a support member 20 having on its upper surface a heater board 16, which is formed by a semiconductor manufacturing process. The heater board 16 has a temperature adjusting heater 17 (a heater or sub-heater) for the heat insulation and temperature adjustment of the recording head 1. The temperature adjusting heater 17 is formed by the same semiconductor manufacturing process as the heater board 16. Numeral 19 indicates a printed circuit board provided on the support member 20. The printed circuit board 19, the temperature adjusting heater 17 and a main heater for ejection 18 are connected together through wire bonding or the like (not shown). The temperature adjusting heater 17 may consist of a heating member formed by a process different form that of the heater board 16 and may be glued to the support member 20.

Numeral 14 indicates a bubble generated through heating by the ejection heater 18. Numeral 15 indicates an ink droplet ejected from the discharge port 11. Numeral 13 indicates a common liquid chamber for enabling ink to enter to recording head 1. The ink enters the recording head 1 as it flows in the direction indicated by the arrow above the liquid chamber shown in the drawing.

FIGS. 10 through 13 are diagrams showing the construction and mode of operation of a conventional cylinder pump. When a timing gear (not shown) rotates, a piston set cam (not shown) pushes a piston presser roller 29 that is attached to a piston rod 27, thereby causing the piston rod 27 to move in the direction indicated by an arrow H shown in FIG. 10. Then, a piston 28 is pushed by a piston presser 27*b* to move in the direction indicated by the arrow H, thereby creating a negative pressure condition in a pump chamber 42. A skin layer is provided on the outer peripheral surfaces of the piston 28 as well as in the interface between the piston 28 and the piston presser 27*b,* so that no ink leaks through communication holes in the foam material forming these members. Further, an ink flow passage 24*e* in a cylinder 24 is closed by the piston 28, so that the piston 28 can be moved solely by an increase in the negative pressure in the pump chamber 42.

Figure 10:
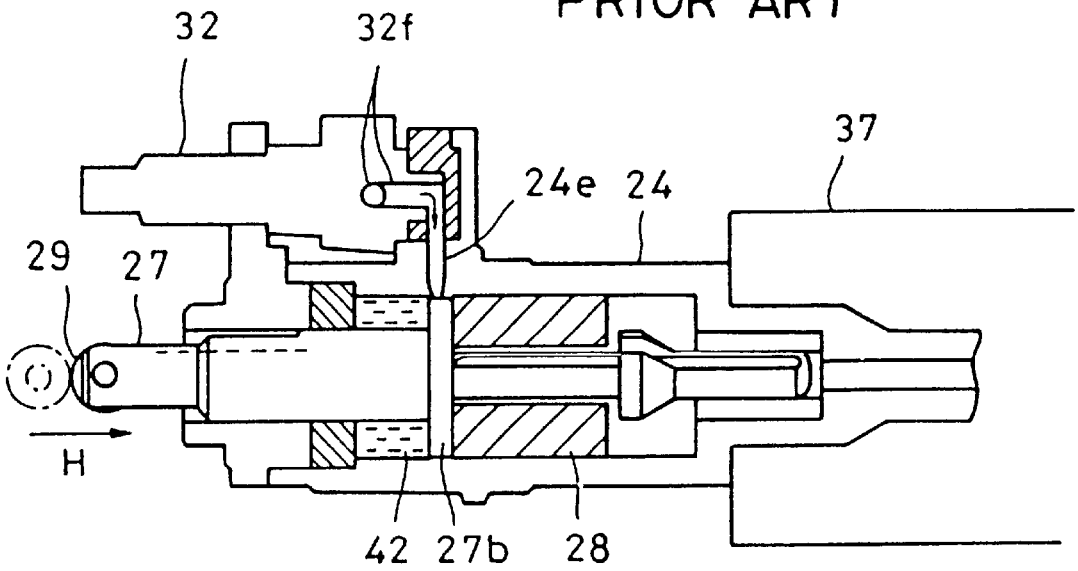
FIG. 10 PRIOR ART
FIGS. 10–13 show the construction and mode of operation of a conventional cylinder pump.

After capping, the ink flow passage 24*e* is opened as shown in FIG. 10, and this condition is maintained for several seconds. During this time, the ink in the head is sucked in through a suction hole in the cap. The ink thus sucked into the cap passes through an ink flow passage 32*f* formed in a cap lever 32, and passes through the ink flow passage 24*e* of the cylinder 24, with the result that the negative pressure in the pump chamber 42 is reduced.

Figure 11:
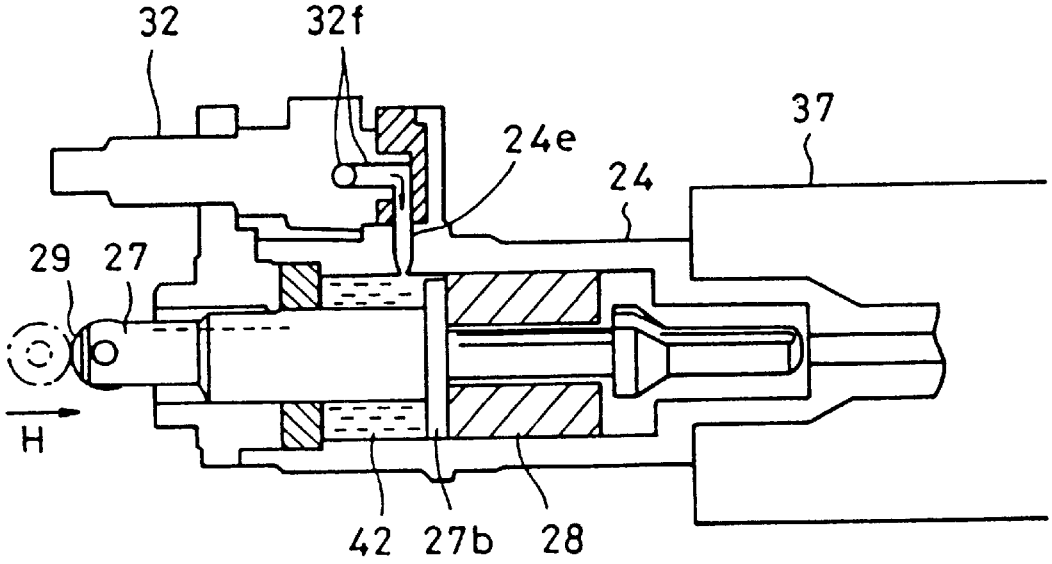
FIG. 11 PRIOR ART

When the timing gear further rotates, the cap cam causes the cap to be slightly separated from the ejection port again. Further, the piston rod 27 moves in the direction indicated by the arrow H as shown in FIG. 11, whereby any remaining ink on the ejection surface and in the cap section, the suction hole and the ink flow passage 24*e,* is sucked in to eliminate the remaining ink in these sections. In thus eliminating the remaining ink in the region extending up to the ink flow passage 24*e,* it is necessary to increase the negative pressure in the pump chamber 42. This can be effected efficiently by increasing the speed at which the cylinder moves in the direction H.

Figure 12:
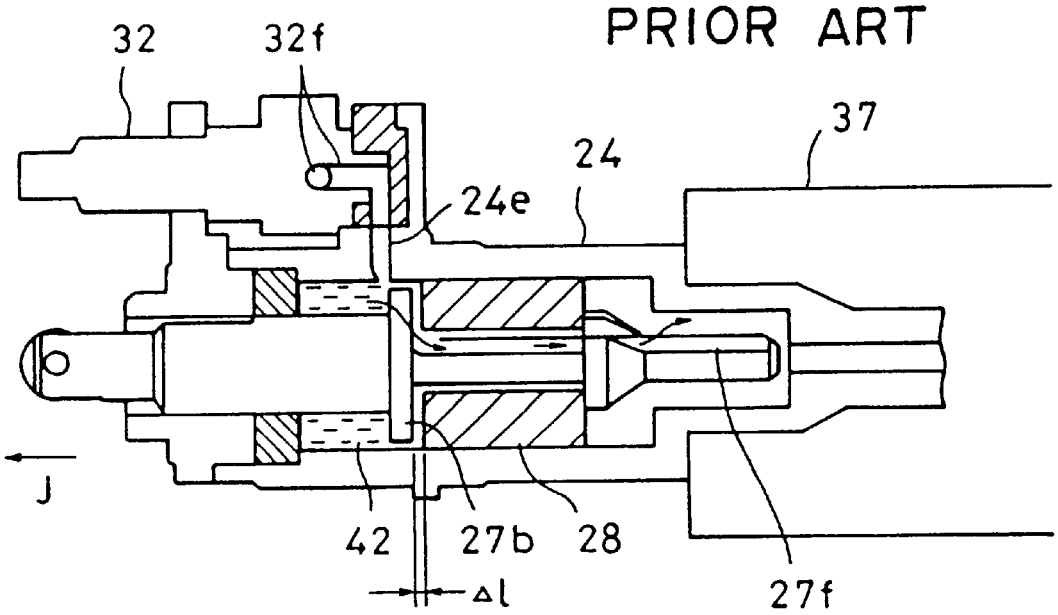
FIG. 12 PRIOR ART
Figure 13:
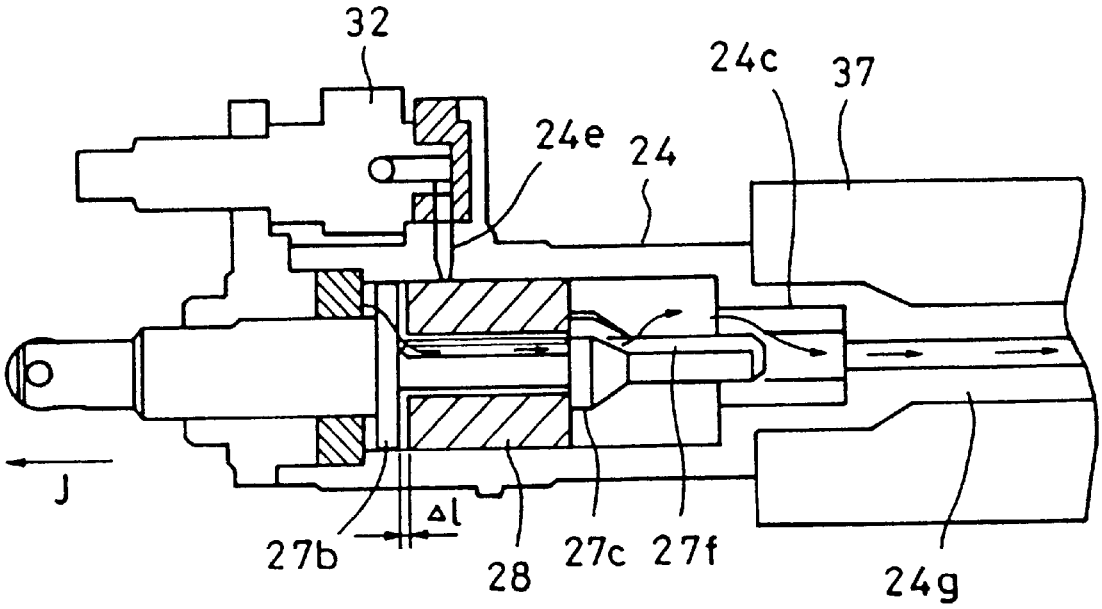
FIG. 13 PRIOR ART

Next, when the timing gear is rotated reversely, a piston reset cam (not shown) draws a piston returning roller (not shown), and, as shown in FIGS. 12 and 13, the piston rod 27 moves in the direction indicated by the arrow J, with a piston support 27*c* in contact therewith, with the result that a gap Δ1 is generated between an end surface of the piston 28 and the piston presser 27*b*. However, due to the movement of the piston rod 27 and the piston 28, the waste ink sucked in the pump chamber 42 passes through the gap Δ1, a groove 27*f* on the piston rod, and an ink flow passage 24*c* of the cylinder 24, and is discharged onto a second near the center of a waste ink absorber 37.

However, in conventional ink jet recording apparatuses, when the waste ink in the pump chamber 42 occupies substantially the entire inner space of the pump chamber 42 when the piston rod is moving in direction J, most of the waste ink is discharged, as described above, through the ink flow passage 24*c* of the cylinder 24 and, further, through a waste ink pipe 24*g*.

(First Embodiment)

Figure 2:
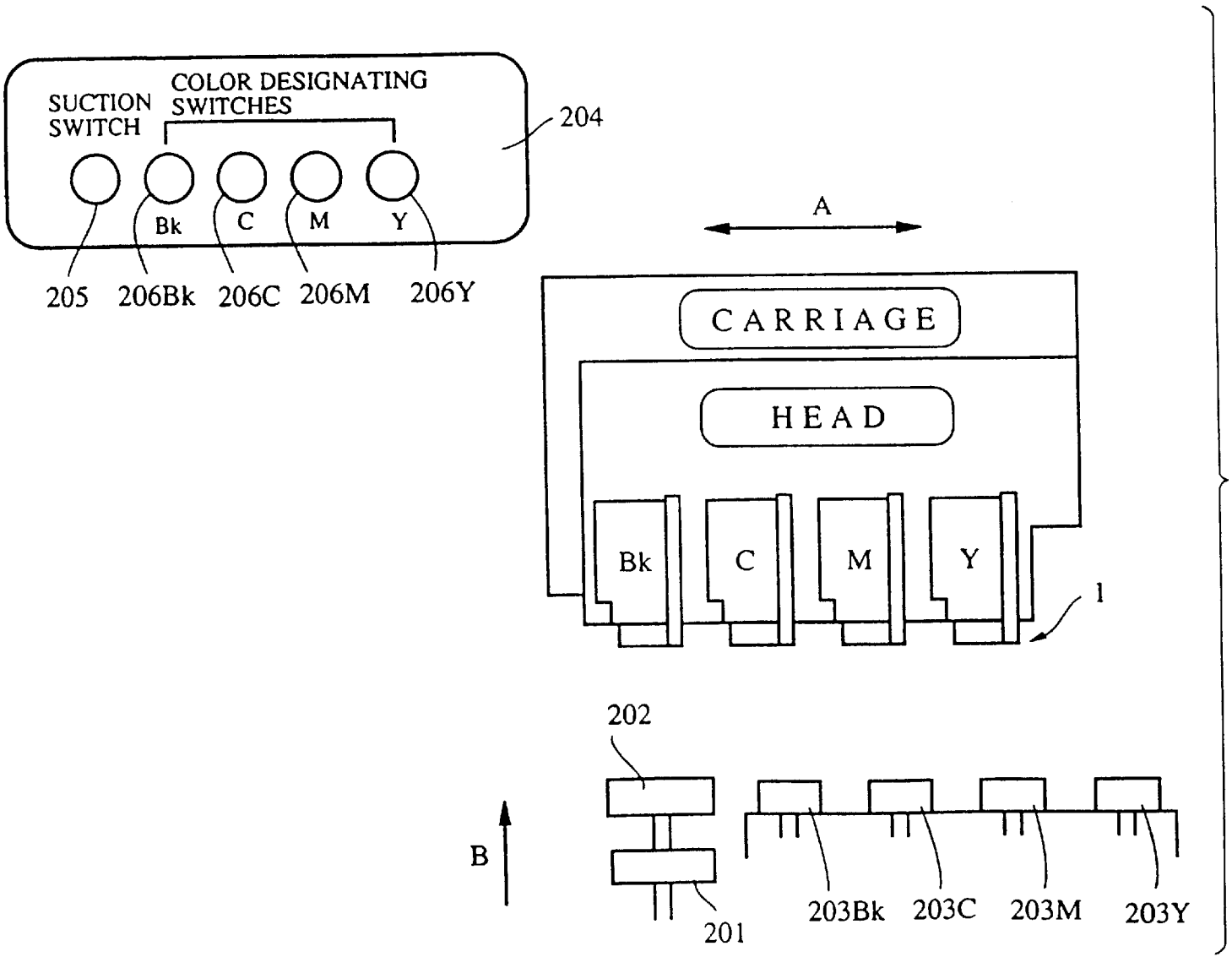
FIG. 2 is diagram showing an example of the construction of a recovery system in an ink jet recording apparatus to which the present invention is applied.

FIG. 2 is a schematic diagram showing a color ink jet recording apparatus having four recording heads for four colors, Bk, C, M and Y. The diagram schematically shows that recording heads mounted on the carriage, and the recovery system for these recording heads. In this embodiment, the suction of inks from the plurality of recording heads is conducted selectively by a single suction pump 201 and a single suction cap 202. Therefore, apart from the suction cap, shutdown caps 203Bk, 203C, 203M and 203Y are provided for all of the recording heads.

Figure 3:
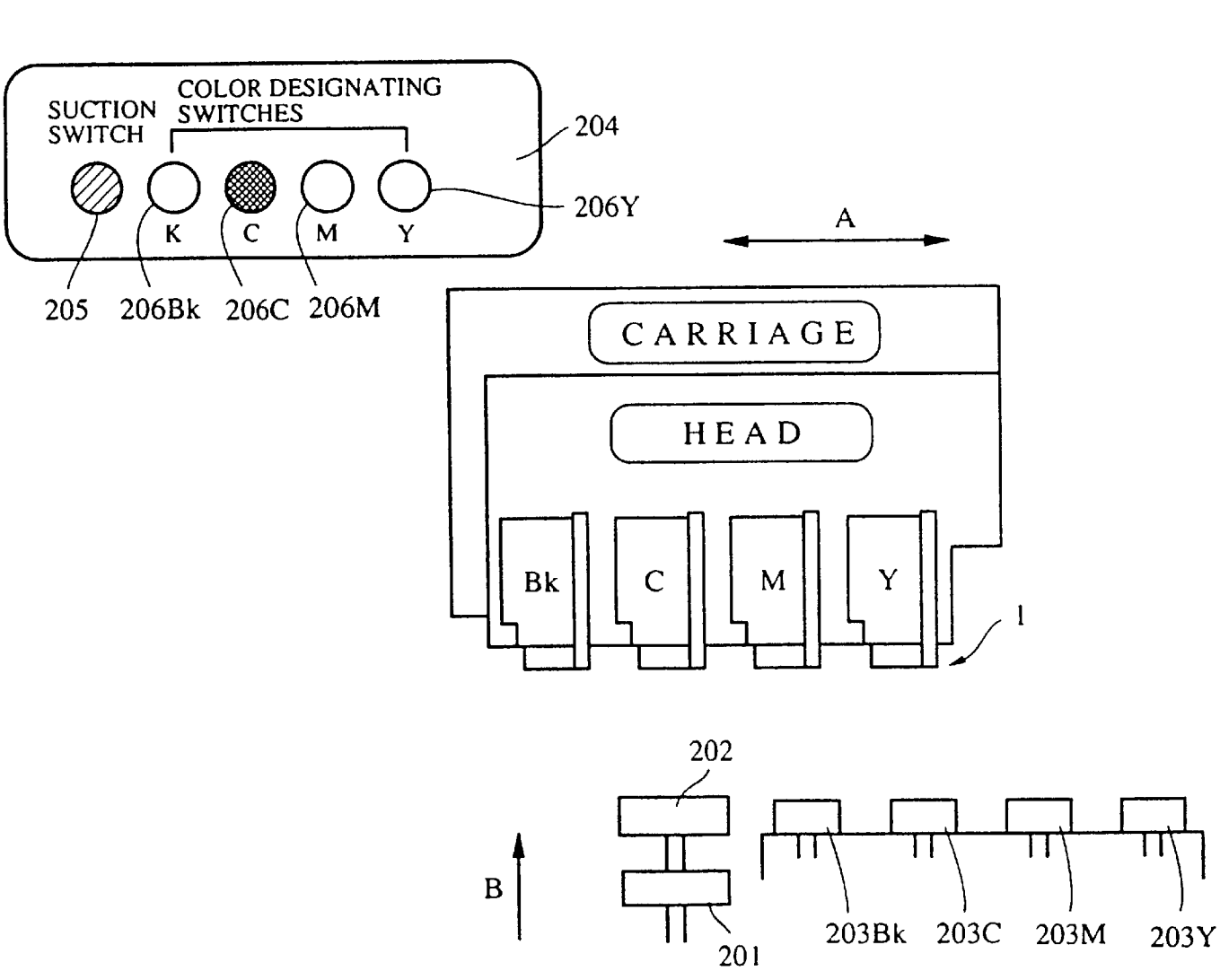
FIG. 3 is a diagram showing an operation of a recovery system in an ink jet recording apparatus to which the present invention is applied.
Figure 4:
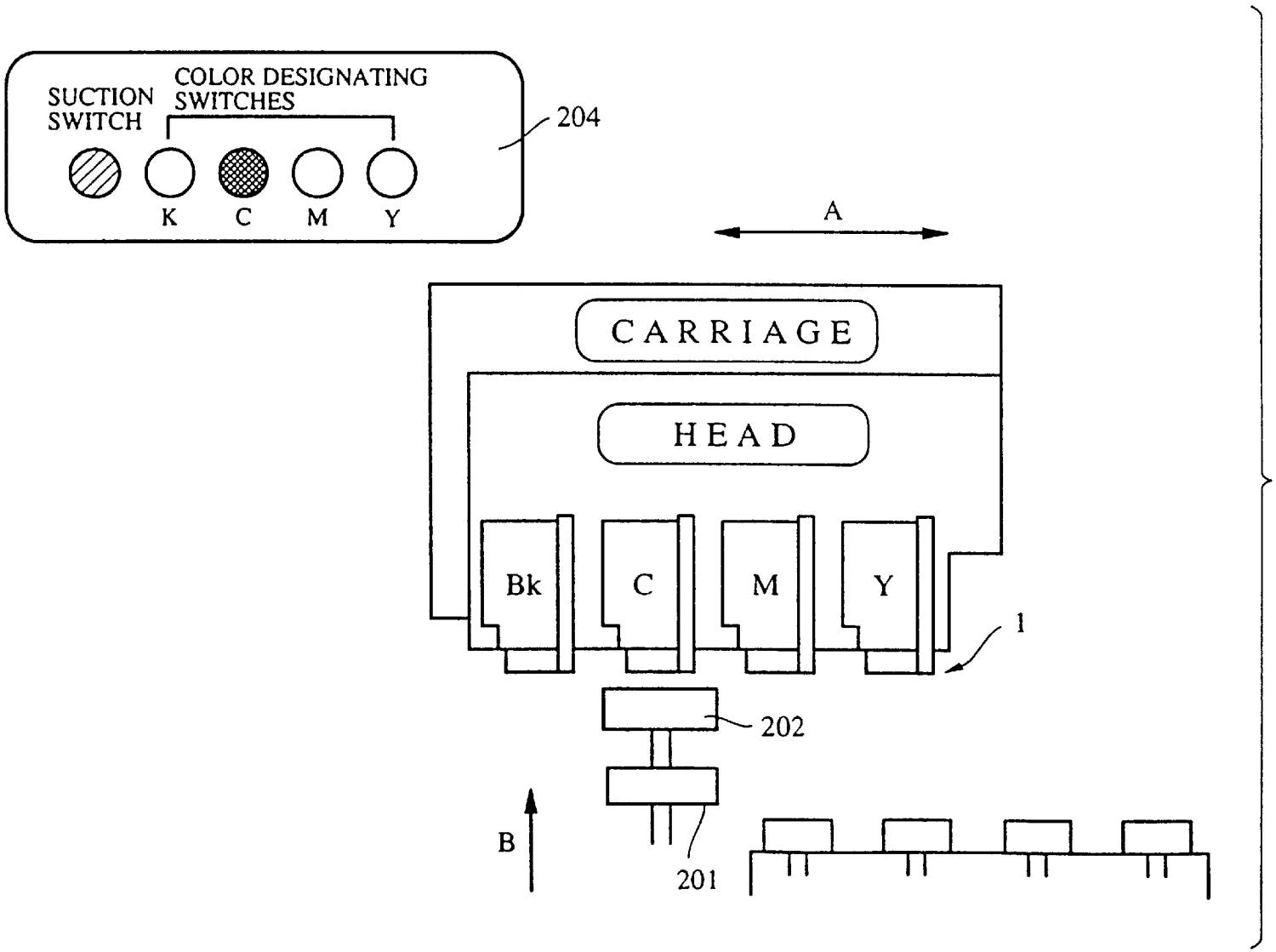
FIG. 4 is a diagram showing an operation of a recovery system in an ink jet recording apparatus to which the present invention is applied.

Arrow A indicates the movement path for the carriage and arrows B indicates the movement path for the caps 202 and 203. The ejection recovery operation for this recording apparatus, constructed as described above, is performed as follows. When ejection recovery through suction is conducted manually, the user, upon finding any recording head having defective ejection, may turn on a suction switch 205 an the corresponding color designating switch (recording-head-designating switch) 206Bk, 206C, 206M and 206Y for the four colors, Bk, C, M and Y, provided on a control panel 204. In accordance with the designation, the carriage moves along the direction A (suction movement), as shown in FIG. 3, bringing the recording head for which suction has been designated to a position where it faces the suction cap, which is stationary. In FIG. 3, the switching is conducted so that suction may be performed on the head corresponding to the color cyan. Next, as shown in FIG. 4, the cap is moved in direction B so as to bring the suction cap 202 into close contact with the recording head concerned and the ink in the recording head is sucked out by reducing the pressure inside the suction cap by means of the pump, thereby removing any dust, sticky ink, etc. from the discharge port.

In the above example, the defective ejection is recognized by the user, and the head on which ejection recovery through suction is to be performed is designated from the control panel. Alternatively, it is also possible to adopt a construction in which any defective ejection is automatically detected, causing suction to be performed exclusively on the defective recording head.

Figure 5:
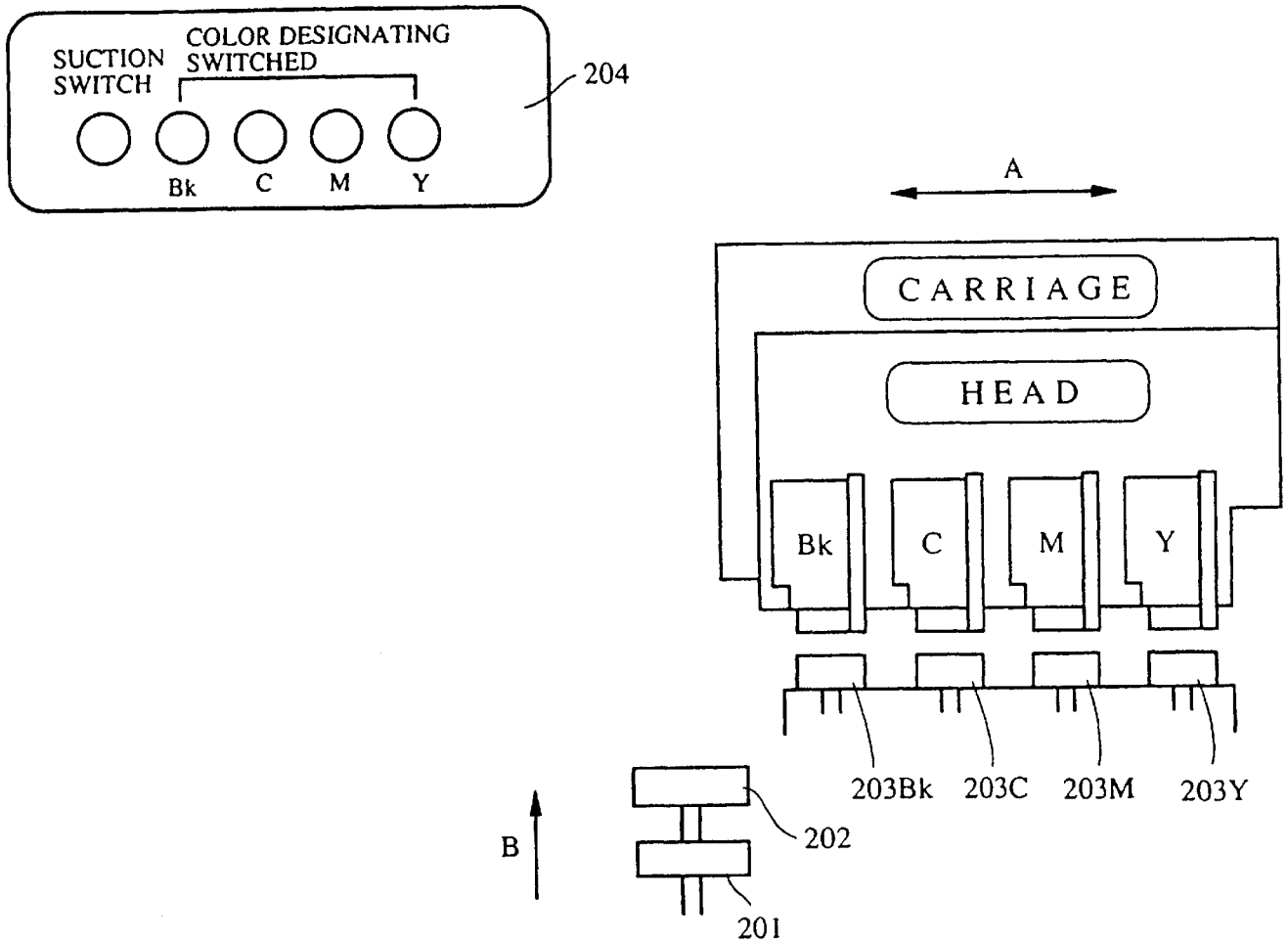
FIG. 5 is a diagram showing an operation of a recovery system in an ink jet recording apparatus to which the present invention is applied.

When the recording apparatus is to remain idle for a long period of time, the shutdown caps 203 move in the direction B (FIG. 5) to cap the recording heads, thereby preventing the ink in the recording heads from becoming thicker or sticky and preventing dust from entering the discharge ports.

Figure 1:
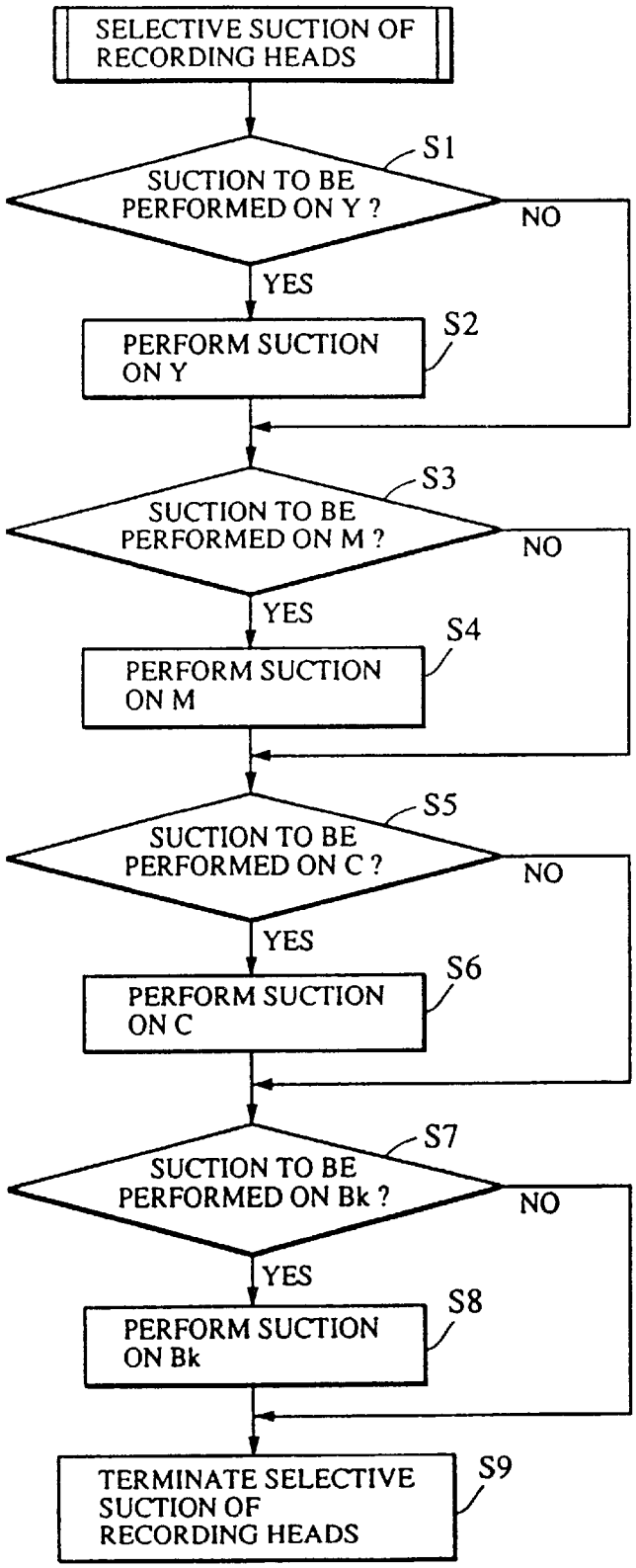
FIG. 1 is a flowchart showing a sequence for ejection recovery through suction for an ink jet recording apparatus to which the present invention is applicable.

The recovery through suction is effected by a sequence as shown in FIG. 1, which is most representative of the features of the present invention. The sequence is intended for a color ink jet recording apparatus in which a single suction cap is shared by four recording heads respectively corresponding to the four colors, Bk, C, M and Y. However, the four colors, Bk, C, M and Y have different degrees of lightness as: Y>M>C>Bk. Table 1 shows the degrees of lightness (L*) of these colors when the printing duty on coated paper is 100% of each color.

TABLE 1

| Ink Color | Lightness (L*) |
|---|---|
| Black | 28.22 |
| Cyan | 52.06 |
| Magenta | 53.47 |
| Yellow | 86.00 |

Lightness (L*) is a degree of a characteristic of a color regarding the amount of light reflected by an object of that color. It is measured in a conventional manner according to the Commission Internationale de l'Eclairage (CIE). In its use in connection with the present invention, the term "lightness (L*)" is taken to mean CIE 1976 psychometric lightness.

FIG. 1 is a flowchart showing a sequence of an ejection recovery through suction according to a preferable embodiment of the present invention. The flowchart is used for determining the order in which ejection recovery through suction is to be conducted on recording heads which eject inks of Y, M, C and Bk, respectively. If there is a command for performing recovery through suction, a judgment is made in step S1 as to whether recovery through suction is to be performed on the recording head corresponding to the yellow ink or not. If the judgment result is YES, recovery through suction is performed in step S2. A similar judgment is made with respect to each of the colors, M, C and Bk, successively in that order, recovery through suction for each color being effected or not according to the judgment result. The order in which suction recovery through suction is to be conducted on these recording heads is in agreement with the order of lightness shown in Table 1, which shows, in accordance with the descending order of lightness, the respective degrees of lightness of the four colors in a recorded image.

By performing ejection recovery through suction successively in accordance with the descending order of the degrees of lightness of the inks, it is possible to minimize the adverse effects due to the mixing of the inks on the ejection surfaces of the recording heads even if the ejection recovery through suction is conducted on all the recording heads in one capping operation.

Figure 14:
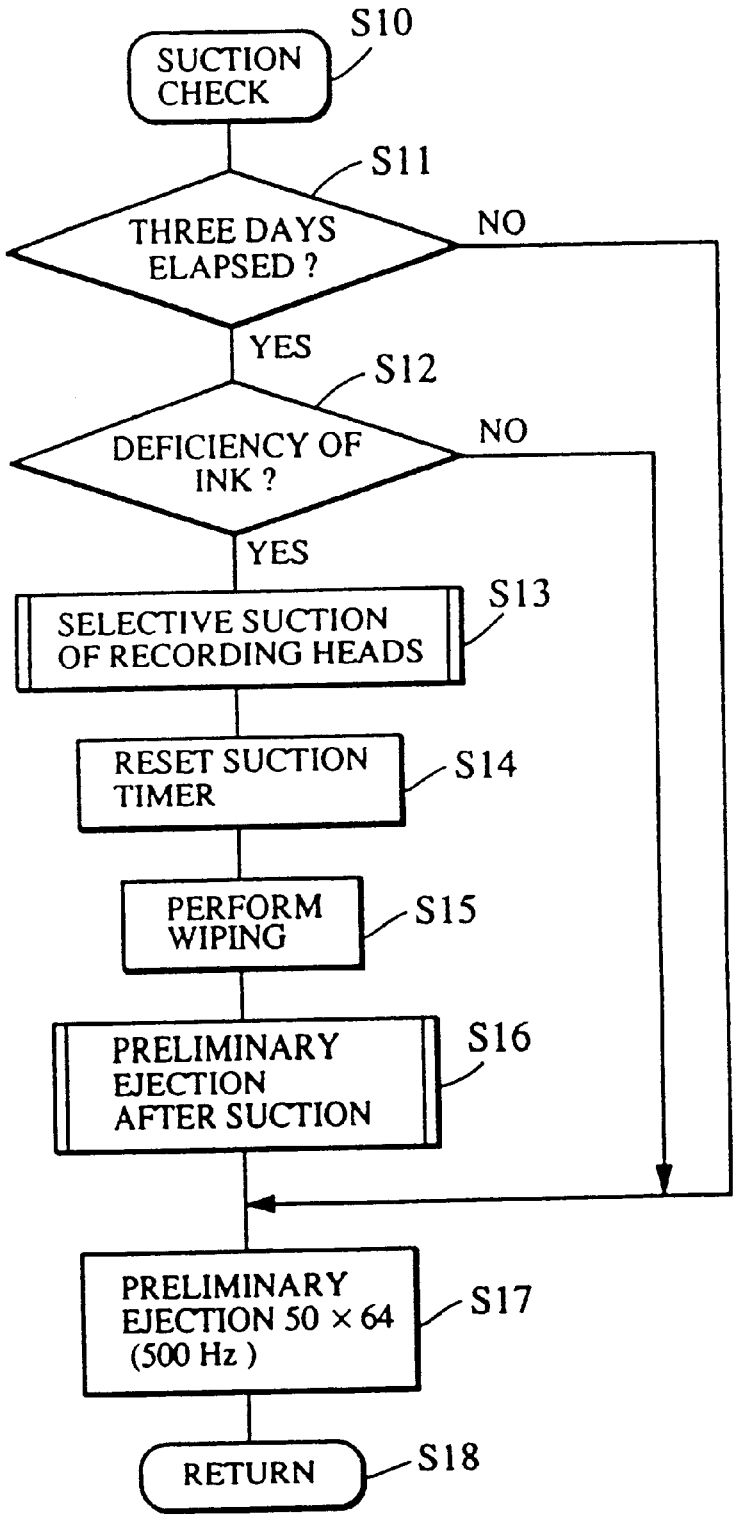
FIG. 14 is a flowchart showing a suction checking sequence.
Figure 15:
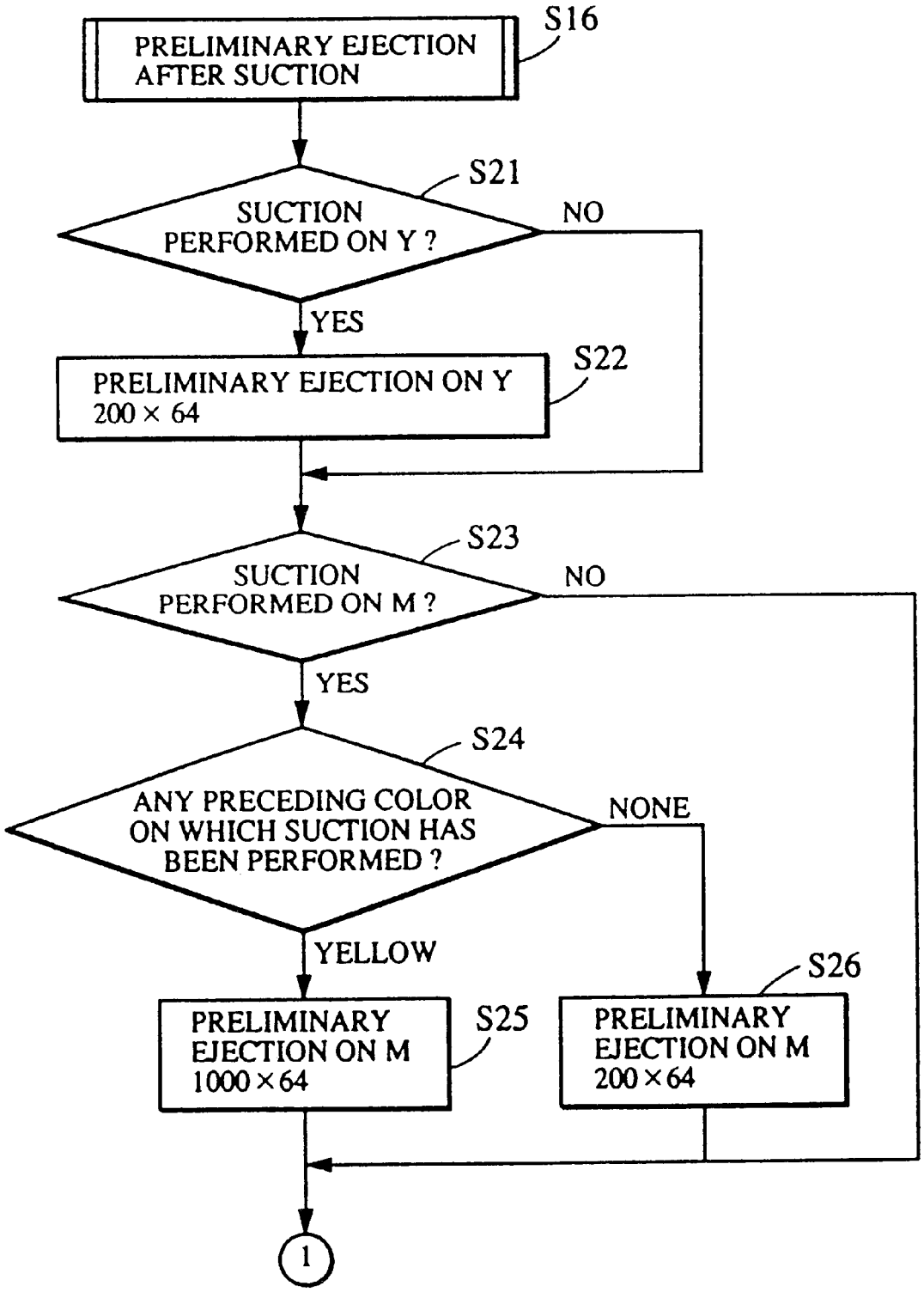
FIGS. 15 and 16 are flowcharts showing a preliminary ejection sequence to be conducted after a sucking operation.
Figure 16:
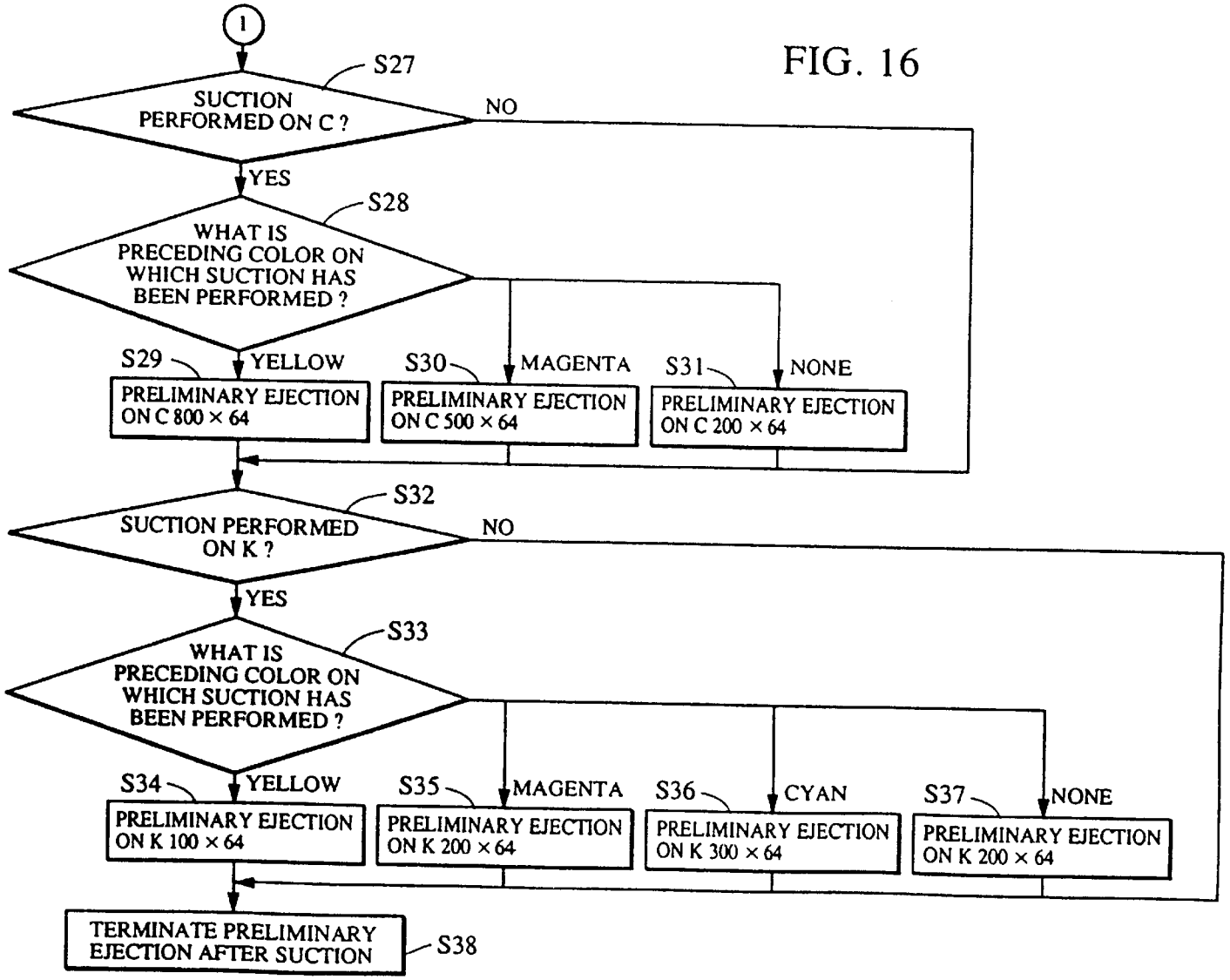

FIG. 14 is a flowchart showing a sequence for checking whether ejection recovery through suction is to be effected or not. When the check sequence is started, manually by the user or automatically with a predetermined timing, the shutdown time is checked in step S11. In this embodiment, the shutdown period is counted by a timer, and ejection recovery through suction is performed after a shutdown period of three days or more. When in step S11 the shutdown period is less than three days, preliminary ejection is effected in step S17, with which the checking sequence is completed. When it is determined that the shutdown period is not less than three days, a judgment is made in step S12 as to whether there is any ink in the common liquid chamber 13 and the nozzle. The judgment in step S12 can be made by a method according to which a temperature rise in the head when pulses are applied to the ejection heater is detected. When it is determined in step S12 that there is some ink, preliminary ejection is performed in step S17. When it is determined in step S12 that there is no ink, a recording head is selected for ejection recovery through suction in step S13. This processing in step S13 corresponds to the sequence described above with reference to FIG. 1. In step S14, the timer is reset, and the wiping of the ejection surface of the recording head is conducted in step S15. Next, in step S16, preliminary ejection after ejection recovery through suction is conducted as shown in FIGS. 15 and 16. After this, preliminary ejection is effected in step S17.

Although a judgment is made in step S12 as to whether there is any ink in the common liquid chamber 13 and the discharge port 11, this process is not absolutely necessary on the present invention. It is also possible to conduct ejection recovery through suction after the detection by the timer.

The preliminary ejection operation in step S16 of FIG. 14 will be explained with reference to FIGS. 15 and 16.

In the recording apparatus of this embodiment, ejection recovery through suction for a plurality of recording heads is performed by a single cap used exclusively for ejection recovery. Thus, this recording apparatus may encounter a problem in that some drops of the ink from a recording head which has undergone ejection recovery through suction may adhere to the ejection surface of the next recording head, resulting in mixed color dots being formed on the recording paper. The ink thus adhering to the next head cannot be completely wiped off even by the wiping process in step S15 of FIG. 14, and some ink drops will remain on the ejection surface. The preliminary ejection after ejection recovery operation through suction is performed for the purpose of removing such ink on the ejection surface and, in particular, ink from the nozzle of another recording head.

In the preliminary ejection sequence described with reference to FIGS. 15 and 16, the number of times that preliminary ejection is to be effected on a recording head is determined depending upon the preceding recording head which has undergone ejection recovery directly before that recording head. When the directly preceding recording head which has undergone ejection recovery through suction uses an ink having a relatively low degree of lightness, the number of times that ejection is to be performed for the next head is set relatively large. Further, since the ejection recovery through suction is performed in accordance with the descending order of lightness, and, further, since the lightness of the ink of a recording head is lower than that of the ink of the preceding head which has undergone ejection recovery through suction directly before that recording head, the adverse effects of color mixing are mitigated, so that the number of times that ejection is to be performed with respect to an ink having a low degree of lightness may be set at a relatively small value.

Thus, in this sequence, the suction is performed in accordance with the descending order of ink lightness, whereby, even in a case where ejection recovery through suction is performed on a plurality of recording heads by using a single cap for ejection recovery through suction, the problem of mixing of different inks on the ejection surfaces of the recording heads can be mitigated. Further, in the preliminary ejection after ejection recovery through suction, the number of times that preliminary ejection is to be performed for minimizing the mixing of colors on the paper can be reduced, whereby the requisite time for preliminary ejection can be reduced, thereby attaining an improvement in throughput.

Further, due to the reduction in the number of times that preliminary ejection is to be performed, it is possible to reduce the amount of waste ink, thereby attaining a reduction in operating cost. Further, it is possible to reduce the size of the waste ink tank in the recording apparatus body, thereby making it possible to reduce the size of the apparatus body.

Table 2 shows the requisite number of times that preliminary ejections have to be effected for making the color mixing on the paper inconspicuous with respect to cases where suction is successively performed on two inks of different colors.

As can be seen from Table 2, a larger number of preliminary ejections is required when suction is performed on a recording head using an ink of a relatively high degree of lightness subsequent to a recording head using an ink of a relatively low lightness than in the reverse case. The lower the lightness of an ink, the less it is affected by color mixing.

TABLE 2

| Ink Color | | Number of Preliminary Ejections Suction order: | |
|---|---|---|---|
| A | B | A → B | B → A |
| Black | Cyan | 800 | 300 |
| Black | Magenta | 1000 | 200 |
| Black | Yellow | 3000 | 100 |
| Cyan | Magenta | 600 | 500 |
| Cyan | Yellow | 2500 | 800 |
| Magenta | Yellow | 2000 | 1000 |

In the above-described example, recording heads needing ejection recovery through suction are detected with a predetermined timing, and suction is performed successively in accordance with the descending order of ink lightness. However, it is also possible to obtain the same effect as described above whenever a sucking operation is to be performed after, for example, a predetermined operation, such as ink tank replacement or recording head replacement, by performing suction in accordance with the descending order of ink lightness exclusively on those recording heads needing ejection recovery through suction.

(Second Embodiment)

Next, a second embodiment of the present invention will be described. In the second embodiment, which is based on the first embodiment described above, the number of times that preliminary ejection is to be performed after ejection recovery through suction can be further reduced, thereby making it possible to reduce the amount of waste ink.

When an ejection recovery operation through suction is performed on a plurality of recording heads using inks of different colors by using a single cap for ejection recovery through suction, some drops of the ink of one recording head may adhere to the ejection surface of another recording head, resulting in mixed color dots being formed on the recording paper as described above. The degree of conspicuity of the color mixing varies according to the printing duty (the number of dots per unit area of the recording medium or the number of ink droplets discharged per unit time). In view of this, the printing duty after ejection recovery through suction is detected, and, in accordance with the printing duty thus detected, the number of times that preliminary ejection is to be performed is determined, thereby making it possible to further reduce the amount of waste ink.

(Third Embodiment)

Next, a third embodiment of the present invention will be described. The third embodiment, which is based on the first embodiment like the second embodiment, also aims at a reduction in the amount of waste ink due to preliminary ejection.

In this embodiment, the preceding recording head which has undergone ejection recovery through suction is memorized, and the number of times that preliminary ejection after ejection recovery through suction is to be performed on the next recording head is determined according to such preceding recording head, whereby it is possible to make the color mixing on the paper inconspicuous without any surplus preliminary ejections.

Further, a still greater effect can be obtained by determining the number of times that preliminary ejection is to be performed for a recording head according to the time elapsed since the ejection recovery through suction of the preceding recording head and the number of preliminary ejections conducted during that period.

As described with reference to the first, second and third embodiments, by successively conducting ejection recovery through suction on the recording head in accordance with the descending order of ink lightness, it is possible to mitigate the adverse effects of ink mixing and to reduce the number of preliminary ejections as compared with the case where ejection recovery through suction is performed at random. These embodiments provide the following advantages:

1. Due to the reduction in the requisite time for preliminary ejection, it is possible to attain an increase in throughput.
2. Due to the minimum wastage of ink, it is possible to attain a reduction in operating costs.
3. Due to the reduction in the amount of waste ink, the size of the waste ink tank can be reduced, thereby making it possible to reduce the size of the entire recording apparatus body.

(Fourth Embodiment)

Next, a fourth embodiment of the present invention will be described in detail with reference to the drawings.

Figure 17B:
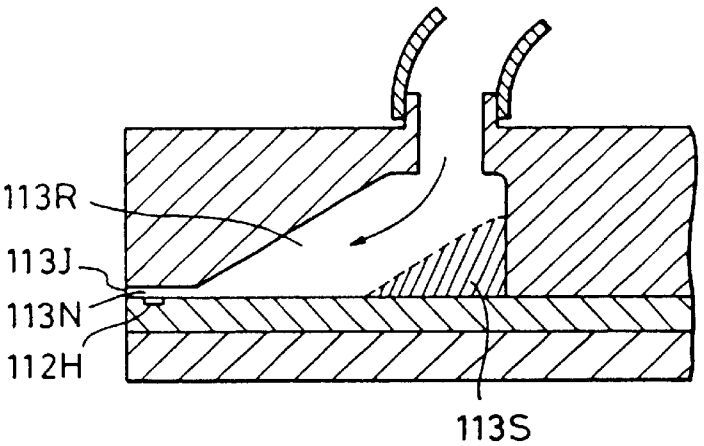
FIG. 17B PRIOR ART
FIGS. 17A, 17B and 17C are a schematic overall view and partial enlarged views of the interior of a conventional head for illustrating the operating principles of the present invention.
Figure 17A:
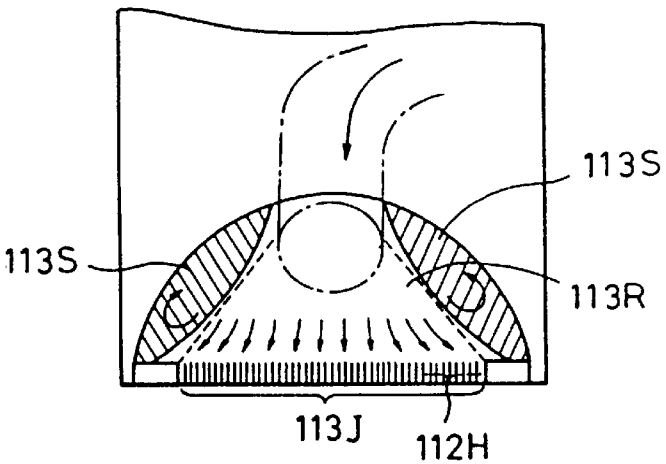
FIG. 17A PRIOR ART

FIGS. 17A and 17B depict conventional recording head for illustrating the principles of the present invention, of which FIG. 17A is a schematic view of a recording head illustrating the ink flow in the common liquid chamber and the ink passages as seen from above, and FIG. 17B is a schematic side sectional view of the corresponding portion of the recording head.

In FIGS. 17A and 17B, when ink is discharged from a common liquid chamber 113R through discharge ports 113J by continuous ejection, ejection recovery through suction, etc., an ink flow as indicated by arrows in the drawings is generated. When such an ink flow is generated, regions where there is substantially no ink flow are often generated as indicated by shaded portions 113S, depending upon the configuration of the common liquid chamber 113R and the positions of arrangement of the discharge ports 113J with respect to the liquid chamber 113R. Such regions 113S may come into contact with ink flows that are outside the regions to generate eddy currents. An ink flow due to such eddy currents will remain in the regions without being mixed with the ink flow outside the regions. Therefore, the ink inside the regions 113S is hard to discharge to the exterior by preliminary ejection, suction, etc.

On the other hand, when ink discharge by preliminary ejection, suction, etc. is interrupted, a convection is generated in the entire common chamber 113R due to the influences of the eddy currents in the regions 113S, etc., which have been formed by this discharge processing. Further, when performing ink discharge by preliminary ejection, convection currents are also generated in the common liquid chamber 113 by the heat of the ejection heater 112H for generating heat energy for ejection. By such eddy and convection currents, the ink inside the regions 113S is mixed with the ink outside the regions and distributed over the entire space of the common liquid chamber 113R.

Therefore, when ink discharge by operations such as preliminary ejection or ejection recovery through suction is interrupted after it has been conducted for a predetermined length of time, the ink in the regions 113S, formed by the discharge of the ink in the common liquid chamber 113R, is distributed over the entire common liquid chamber 113R during the interruption period, and, by again performing ink discharge thereafter, most of the ink which was in the regions 113R in the earlier stage of discharge is discharged to the exterior of the recording head through the discharge ports 113J by the ink flow generated by this discharge process. Further, the ink in the regions 113S, having a relatively high viscosity and density, is thinned by mixing. In contrast, in a conventional discharge process in which no interruption is provided during ink discharge, the regions 113S, once formed by the discharge process, continue to exist throughout the discharge process, so that the ink accumulated in the regions 113S will stay in the recording head, with no thinning being effected to lower its density, etc. Thus, at the completion of the discharge process, the ink in the regions 113S may be mixed with other ink portions to adversely affect the image recorded by ejecting the ink.

Figure 17C:
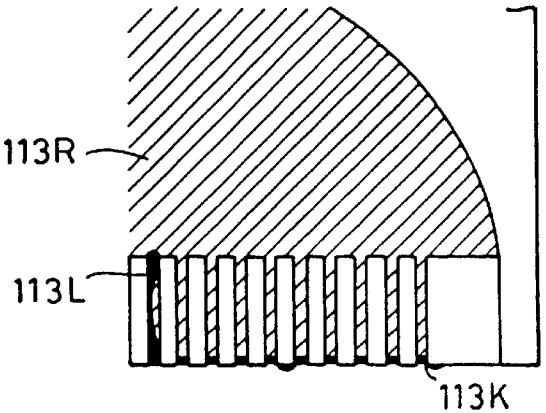
FIG. 17C PRIOR ART

FIG. 17C shows how some of the ink of another head is allowed to intrude into a recording head and the discharge ports thereof during an ejection recovery operation such as wiping or suction. When the amount of such ink allowed to intrude is small, the ink mixing only occurs in the discharge ports, as indicated at 113K, so that it is possible to eliminate density inconsistencies without providing any interruption means. When the amount of ink allowed to intrude is large, the ink mixing may affect even the common liquid chamber 113R as in the case of the discharge port 113L. In the case of such significant ink mixing, it is necessary to reduce the amount of intruding ink in the liquid chamber to a level that is insignificant for practical uses by an ink discharge operation as in the case of concentration due to evaporation as described above.

Figure 18:
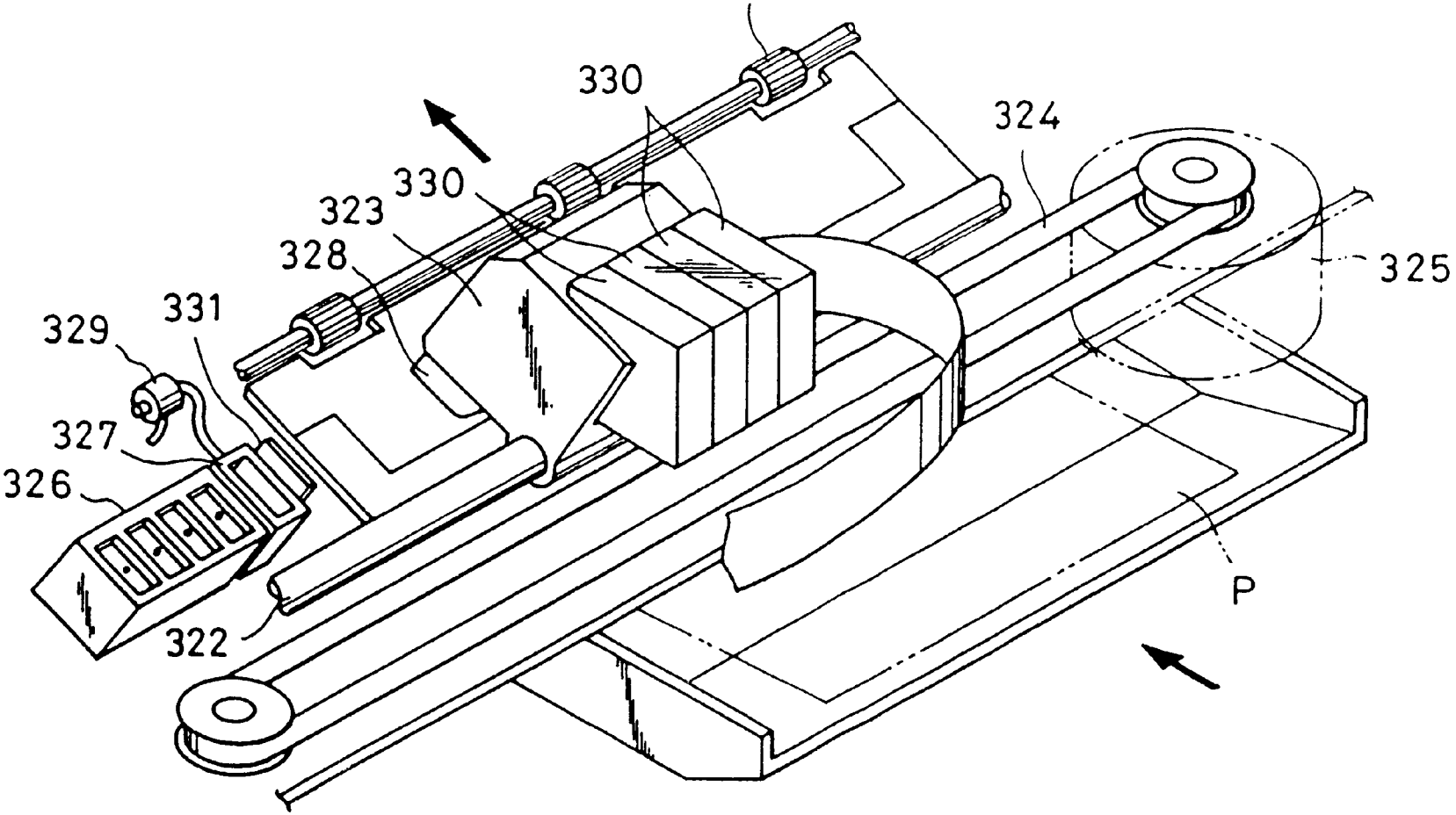
FIG. 18 PRIOR ART
FIG. 18 is an external perspective view showing an example of a conventional ink jet recording apparatus suitable for executing the ink refreshing method of the present invention.

FIG. 18 is a schematic perspective view showing an example of a conventional ink jet recording apparatus in which it is possible to perform ink discharge on the recording head, as in the case of the apparatus shown in FIGS. 17A through 17C. This apparatus consists of an ink tank separation type, full color printer in which ink tanks for the four colors, black (Bk), cyan (C), magenta (M) and yellow (Y) are replaceable. The apparatus is used as an output terminal of a personal computer, work station, etc. The head used in this printer has a resolution of 360 dpi and a driving frequency of 6 kHz, each head having 64 nozzles.

In FIG. 18, numeral 328 indicates a four color recording head unit having four recording heads respectively corresponding to the four colors, Y, M, C and Bk. In this unit, the four color heads are formed as components separate from ink tanks 330 for storing inks to be supplied to the recording heads. The recording heads 328 and the ink tanks 330 are detachably mounted on a carriage 323 through a mechanism (not shown). The carriage 323 is slidable on a guide shaft 322, and is connected to a part of a drive belt 324 that is moved by a main operating motor 325, whereby the recording heads 328 are moveable for operation along the guide shaft 322. Numeral 321 indicates feeding rollers which are substantially parallel to the guide shaft 322 and which are arranged in that portion of the recording area which is on the farther side with respect to the plane of the drawing. The feeding rollers 321 are driven by a sub-operation motor (not shown) to feed a recording medium P. The recording medium P thus fed faces the ejection surfaces of the recording heads 328, thus forming a recording surface.

Ejection recovery system units 326 and 327 are provided in an area which is adjacent to the recording area and which faces the area where the recording heads 328 are moveable. These ejection recovery system units are used when preliminary ejection or ink suction is performed in the manner as described above with reference to FIGS. 17A through 17C. Of these ejection recovery system units, numeral 326 indicates a plurality of vertically moveable cap units respectively corresponding to the recording heads 328. When the carriage 323 is at a home position facing the cap units 326, the cap units are joined to the recording head section to effect capping thereof. Further, of the ejection recovery system units, numeral 331 indicates a blade for wiping, which blade 331 is also vertically moveable. When performing wiping, the blade 331 moves upwards, as seen in the drawing, to effect wiping as the carriage 323 moves along. Numeral 329 indicates a pump for performing the above ink suction process. After bringing the suction caps 327 into close contact with the heads 328, a negative pressure is generated in the suction caps 327 by this pump, thereby effecting suction. Further, the suction caps 327 also serve as waste ink receivers when ink is discharged through suction. In this embodiment, as shown in FIG. 18, a single preliminary-ejection/suction device for ejection recovery is provided with respect to the four heads, and ejection recovery operation for removing density inconsistencies is conducted successively, one head at a time. This form is very advantageous from the viewpoint of cost reduction and space saving. Although the following description will be given with reference to the case where the single preliminary-ejection/suction device for ejection recovery is provided with respect to four heads, it is also possible, in this invention, to achieve the same effect when four recovery devices are provided for the four heads, respectively.

Figure 19A:
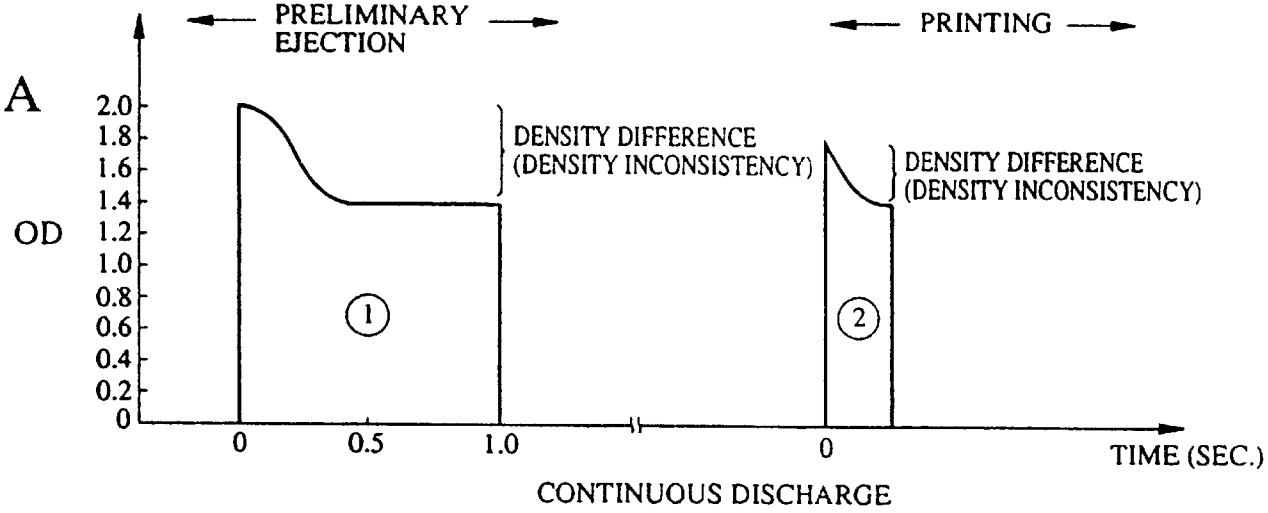
FIGS. 19A and 19B are charts for explaining the effects of the present invention.
Figure 19B:
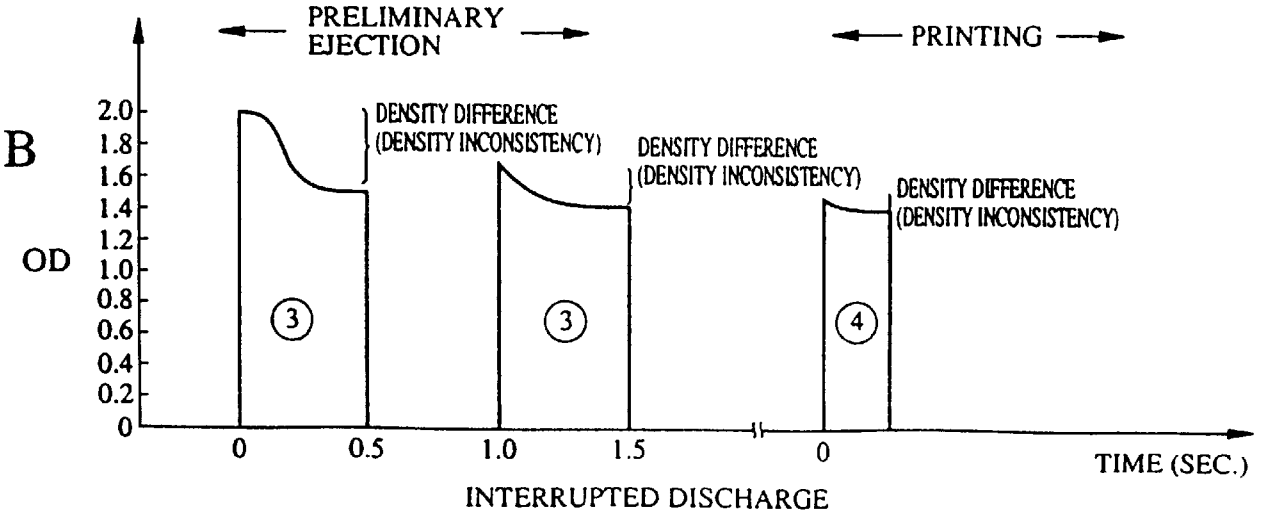

FIGS. 19A and 19B show density inconsistences during printing, of which FIG. 19A shows a case where ink discharge through ejection is continuously effected, whereas FIG. 19B shows a case where an interruption process as described above is provided during the discharge process. In its use in connection with the present invention, "OD" means optical density. It is measured by performing ink jet printing onto standard copy machine plain paper under the same discharge frequency and drive conditions as for the herein described preliminary ejection. After such ejection, the paper was left for a day, and the optical density of the ink was then measured with a Macbeth® RD-914 density meter, manufactured by Kollmorgen Instrument Corporation. In the continuous discharge shown in FIG. 19A, indicated at (1), the ink staying in the regions 113S of FIGS. 17A and 17B is not discharged, causing great density inconsistencies at the start of printing as indicated at (2). In FIG. 19B, the discharge process is performed two times with a predetermined pause therebetween, as indicated at (3) and (3)'. By thus interrupting the discharge process, the ink in the regions 113S is enabled to be mixed with the other ink portions to a sufficient degree during the pause. By discharging the mixed ink by the second discharge (3)', the density inconsistencies generated during printing are reduced.

Figure 20A:
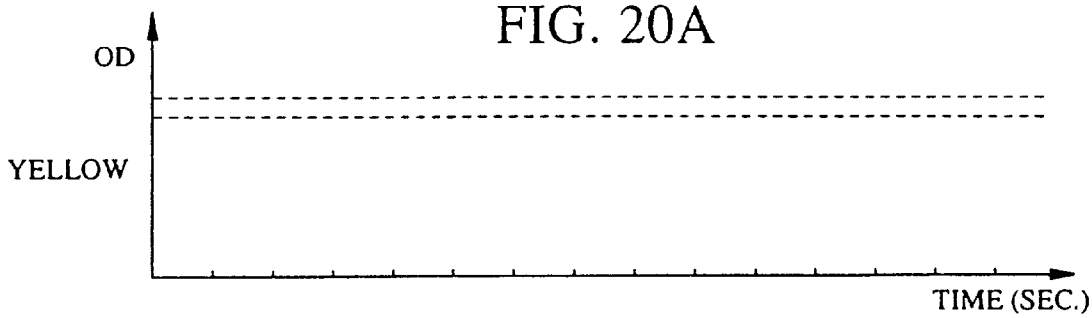
FIGS. 20A–20D are charts showing the permissible density inconsistencies for the colors of a recording apparatus having the construction of an embodiment of the present invention.
Figure 20B:
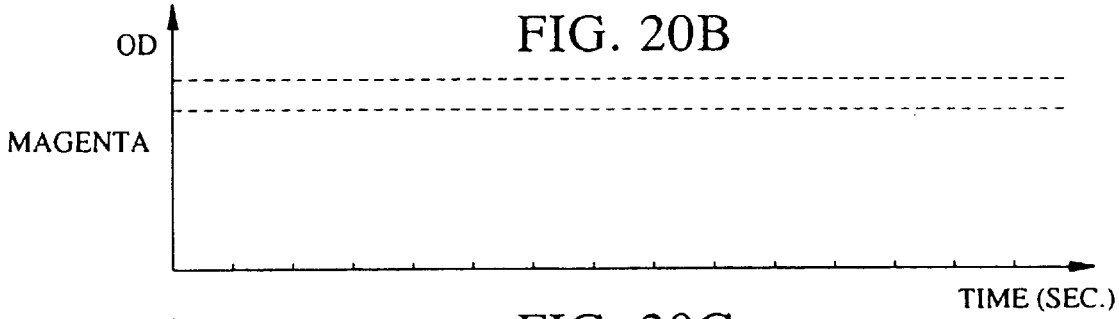
Figure 20C:
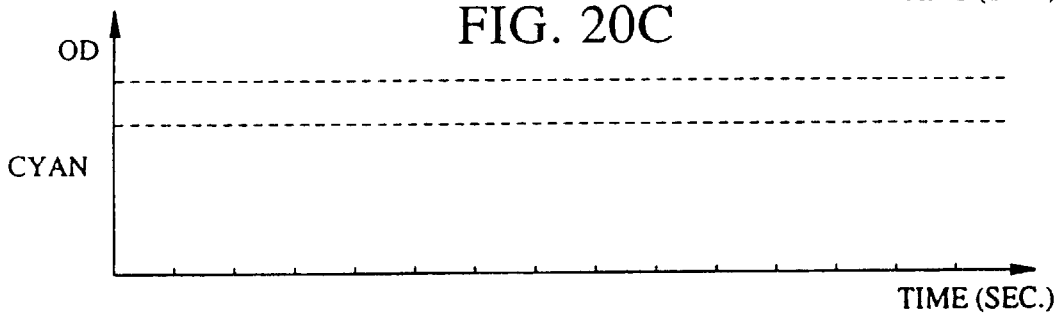
Figure 20D:
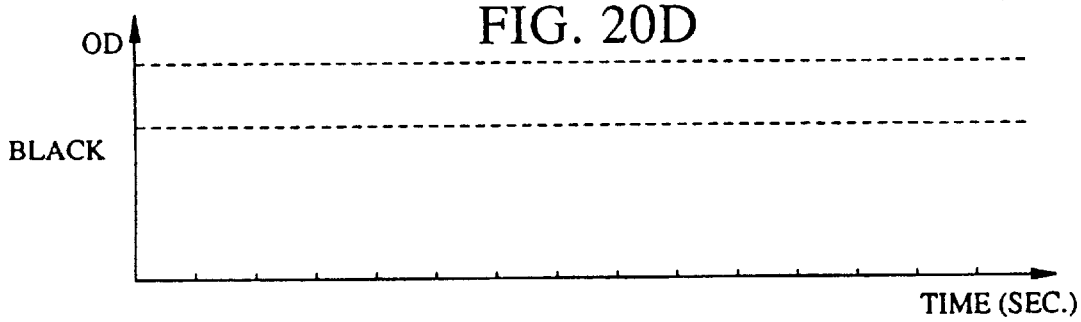
Figure 20D:
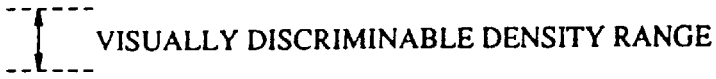
Figure 21A:
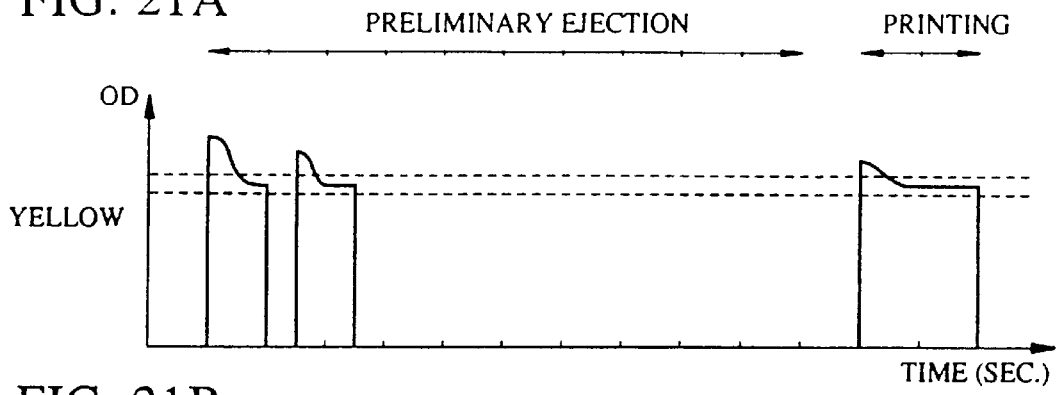
FIGS. 21A–21D are charts showing examples of preliminary ejection and density inconsistencies in a case where the present invention is not applied.
Figure 21B:
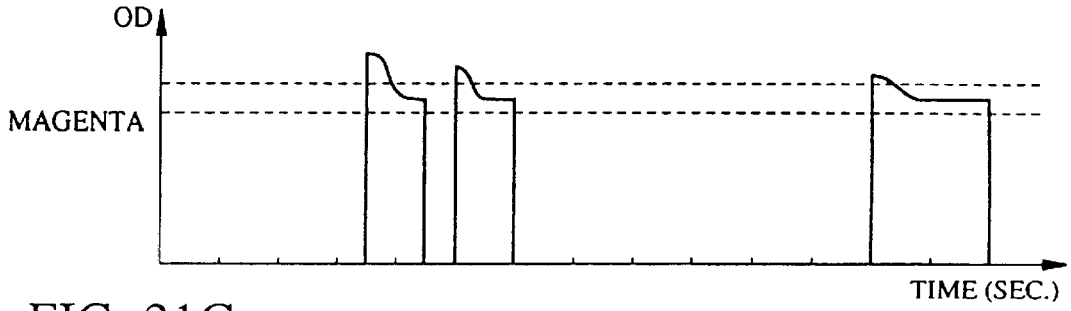
Figure 21C:
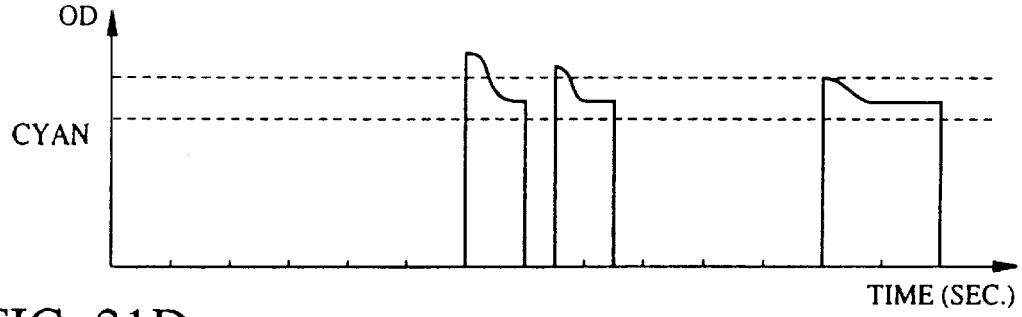
Figure 21D:
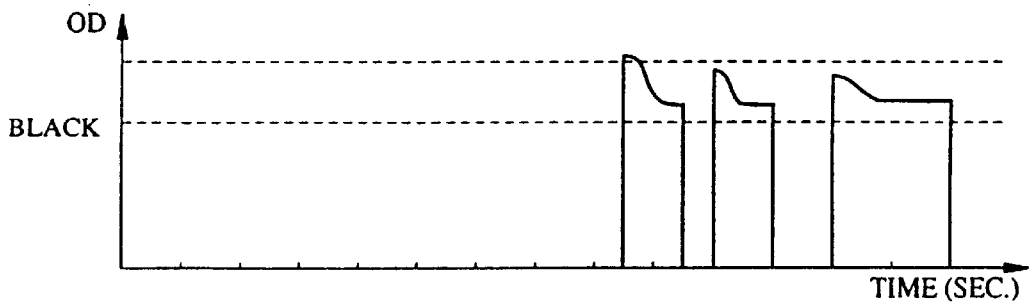
Figure 21D:
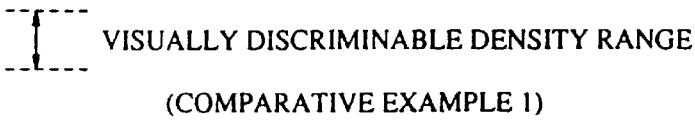
Figure 22A:
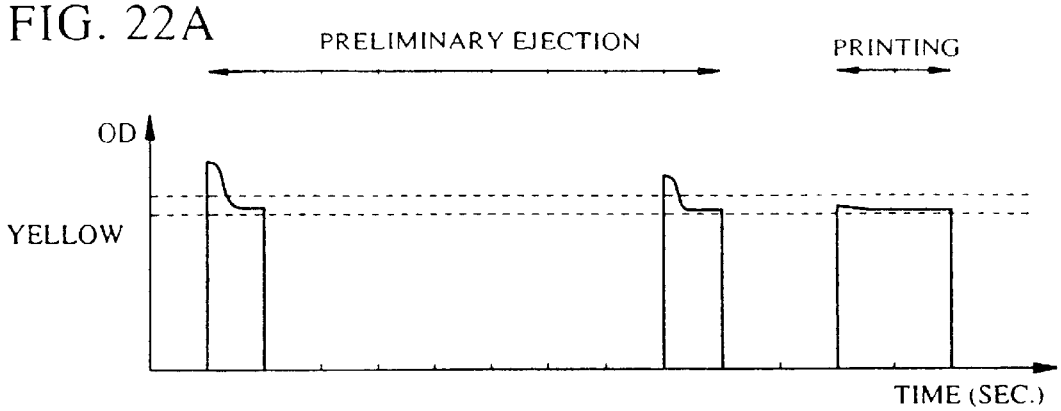
FIGS. 22A–22D are charts showing examples of preliminary ejection and density inconsistencies in a case where the present invention is applied.
Figure 22B:
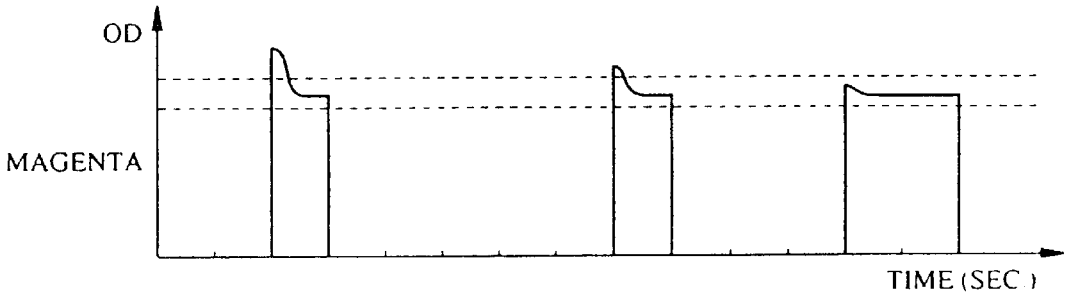
Figure 22C:
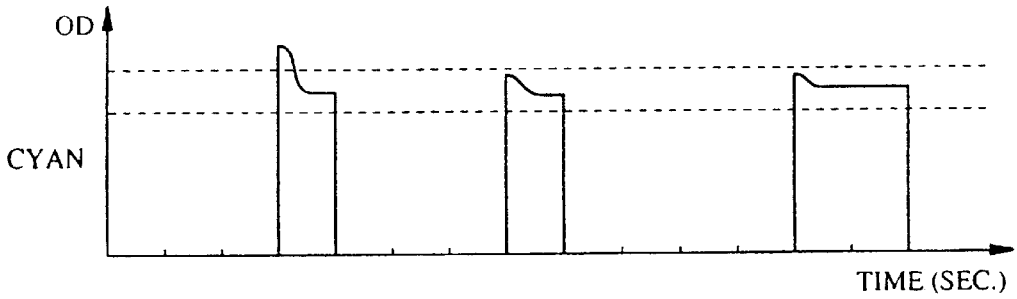
Figure 22D:
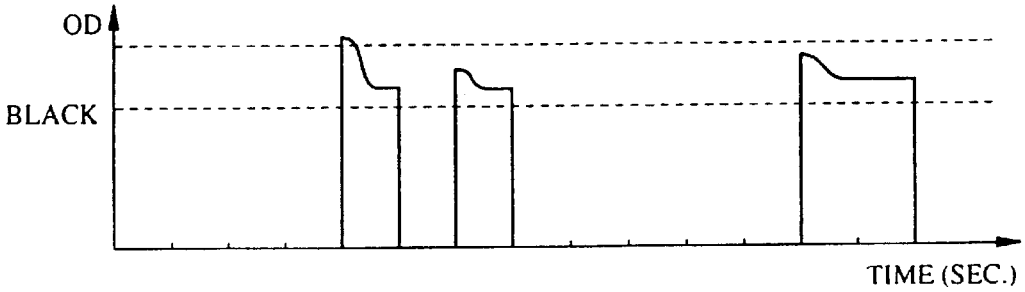
Figure 22D:
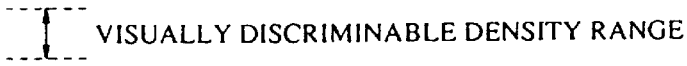

On the other hand, as stated above, it depends upon the kind or density of the dye whether the density inconsistencies are conspicuous or not. For Example, a light color like yellow, shown in FIG. 20A, will undergo thickening by evaporation as in the case of a dark color like black. When density inconsistencies are generated through such thickening, the visually discriminable permissible range is small for a light color like yellow, so that the density inconsistencies have a great influence on the image quality. Similarly, when a light color like yellow is mixed with a dark color during wiping or suction, such mixing tends to be conspicuous due to the small permissible range of such a light color with respect to the density inconsistencies after the mixing. Regarding a color having a low degree of lightness, its mixing with a lighter color is not so conspicuous, so that the image quality deterioration due to the color mixing is of less significance. Thus, in the case where a light color is mixed with a darker color, a longer rest period should be provided than in the reverse case so that the inks in the head may be well mixed with each other before being discharged in order to prevent density inconsistencies more effectively.

FIGS. 22A through 22D show Example 1 in which printing is actually performed by using the recording apparatus of FIG. 18; and FIGS. 21A through 21D show Comparative Example 1 in which printing is performed without utilizing this embodiment of the present invention. In this embodiment, suction was effected on the four heads (the four colors) by using a single suction device, and wiping was successively performed on the four heads by using a single blade member. After that, some ink was discharged onto the paper P as an ejection recovery measure before starting test printing.

When the above ejection recovery is conducted, it is also possible to remove any thickened ink scattered over the surface of the recording heads 323 in the form of mist. However, as described with reference to FIG. 17C, a phenomenon may occur in which some ink of another recording head intrudes into the ejection holes. In such a case, a variation in density is generated in each head at the start of ejection, as in the case of FIG. 19. Further, in the case of a light ink like yellow, conspicuous density inconsistencies are caused when it is mixed with a darker ink.

When ejection recovery was successively conducted on the heads without using this embodiment, as shown in FIGS. 21A through 21D, the density inconsistencies tended to be conspicuous in the case of a light color like yellow, so that the density inconsistencies in the recorded image directly after the start of printing exceeded the visually permissible range, resulting in an inadequate image quality being observed. In the case of a color having a low degree of lightness like black, the density inconsistencies were less conspicuous, so that the variation in density after the mixing remained in the visually discriminable permissible range, the variation being substantially insignificant for practical purposes. Thus, when the same rest period is set for both light and dark colors, ink mixing after ink discharge cannot be effected to a sufficient degree in the case of the head for the light ink, and the purging of the head cannot be performed completely.

When the ejection recovery operation as shown in FIGS. 22A through 22D is conducted by using this embodiment, only such density inconsistencies as are not visually discriminable are generated from the start of printing even in the case of a light color like yellow, in which density inconsistencies tend to be conspicuous. Thus, in accordance with this embodiment, it is possible to further reduce the amount of ink discharged for ejection recovery without involving any deterioration in printing quality.

It will be appreciated that the principles of this embodiment apply equally to the case where discharge recovery is by suction rather than preliminary ejection.

(Fifth Embodiment)

Figure 23:
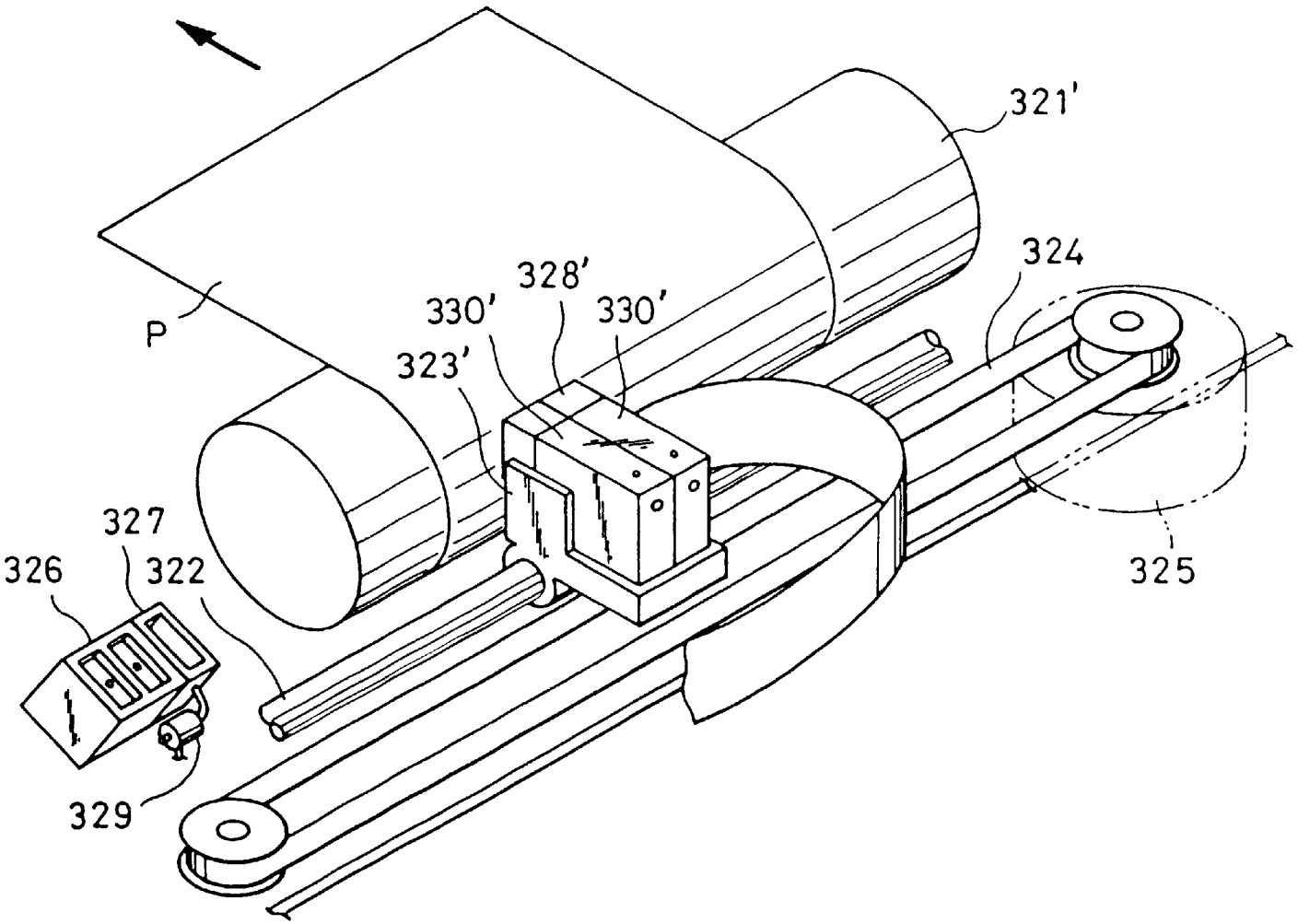
FIG. 23 PRIOR ART
FIG. 23 is an external perspective view of a conventional recording apparatus equipped with a mechanism for ejecting two different inks having different dye densities.

FIG. 23 shows a fifth embodiment of the present invention which consists of a recording apparatus equipped with a mechanism for ejecting two inks having different dye densities. In this embodiment, the recording heads were allowed to stand for a long period of time in the atmospheric air to evaluate the recovery characteristics thereof with respect to density inconsistencies. In FIG. 23, like numerals are used to denote features similar to those depicted in FIG. 18.

Figure 24A:
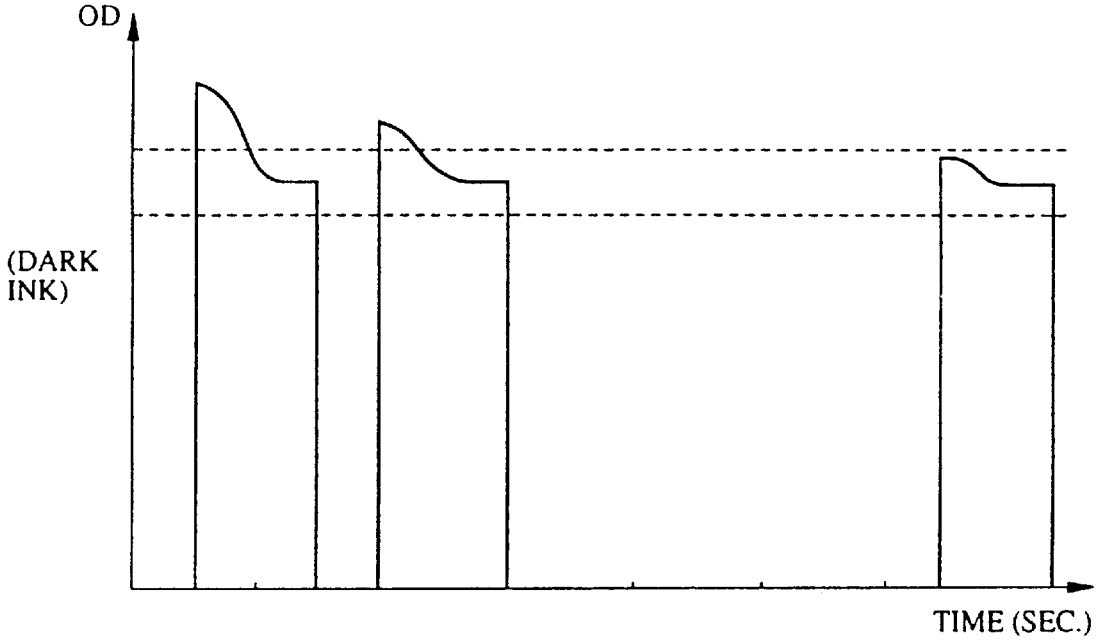
FIGS. 24A and 24B are charts showing the relationship between non-ejection time and density in heads for ejecting two inks having different dye densities as described in an embodiment when recovery is effected through preliminary ejection by a method not according to the present invention.
Figure 24B:
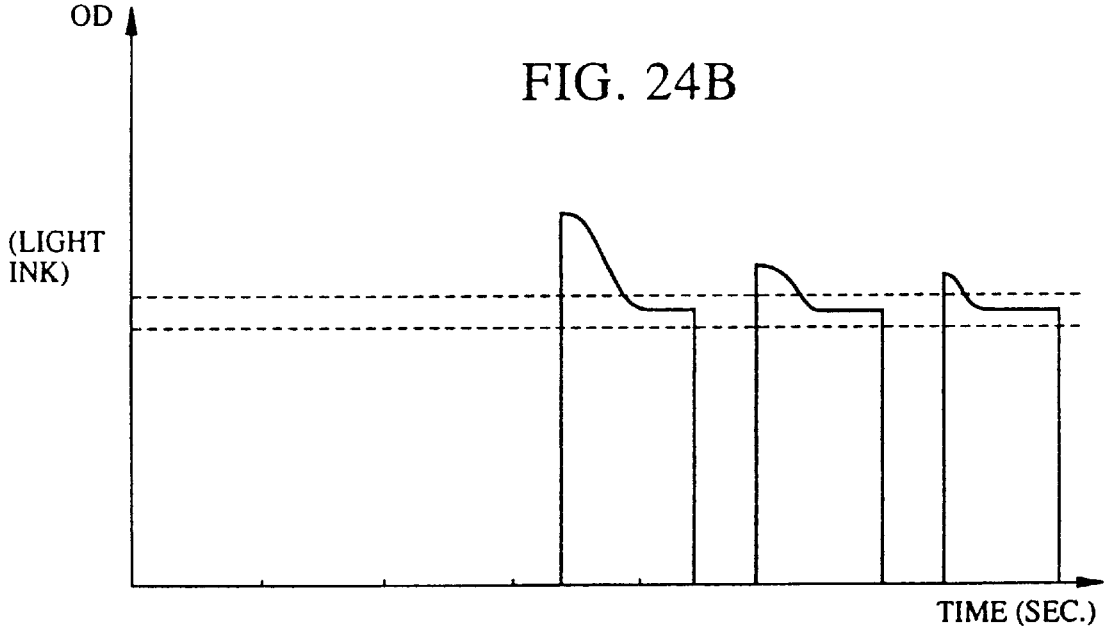
Figure 25A:
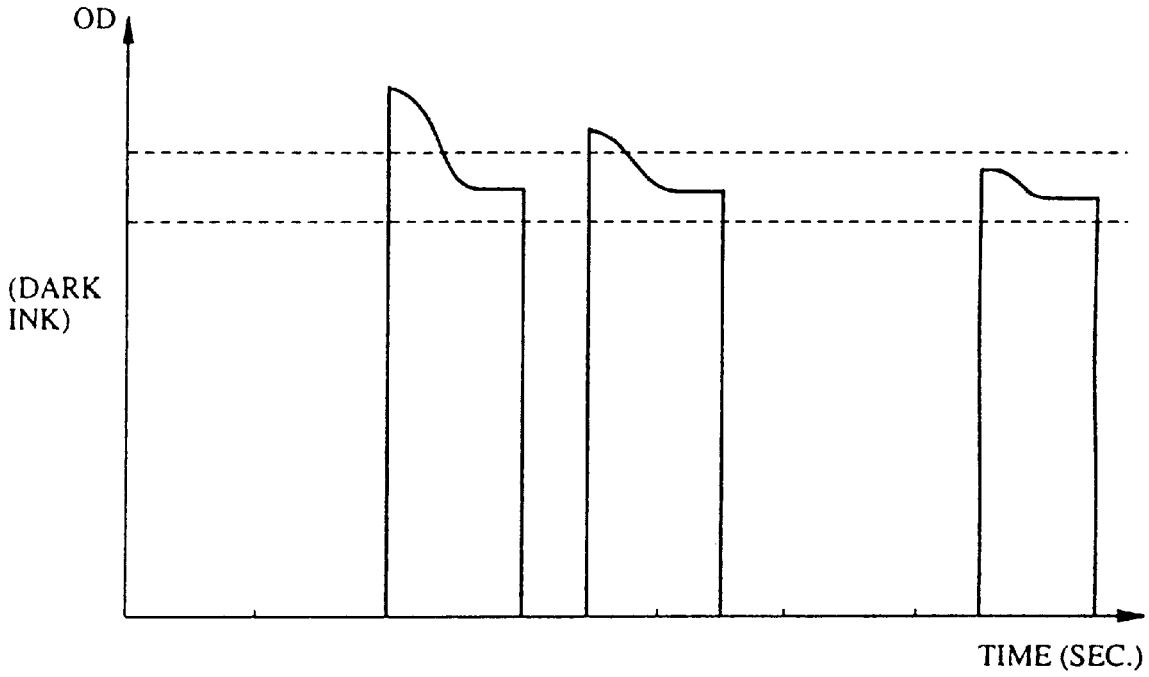
FIGS. 25A and 25B are charts showing the relationship between non-ejection time and density when recovery is effected through preliminary ejection by a method according to the present invention.
Figure 25B:
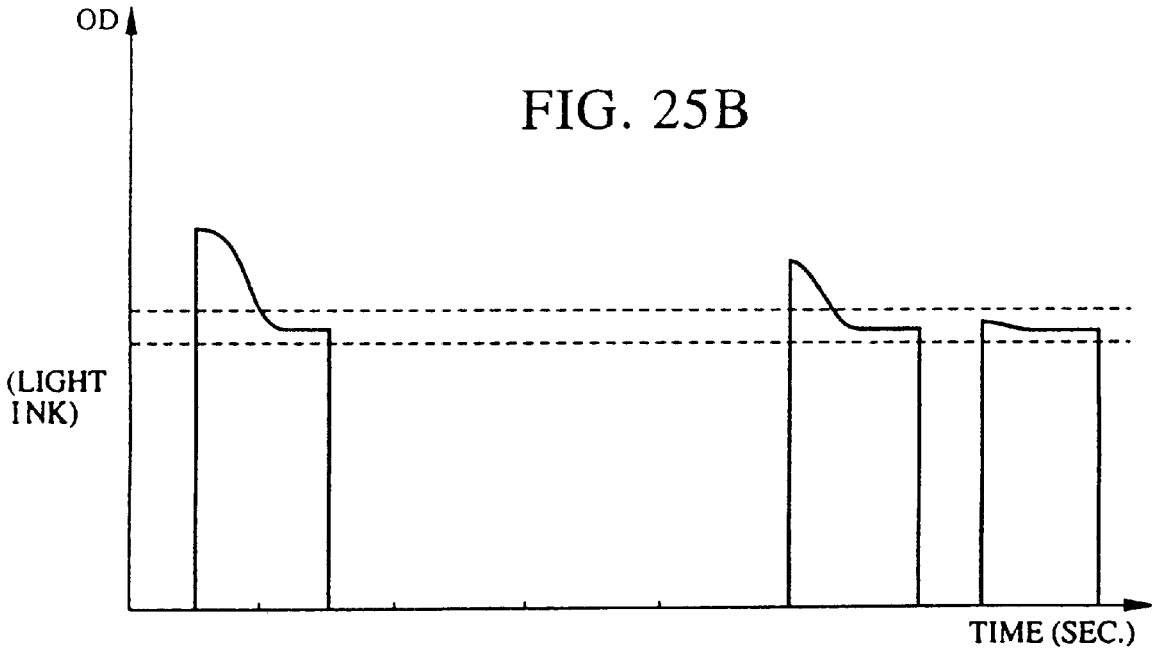

The evaluation of the recovery characteristics of the recording heads with respect to density inconsistencies was made with respected to an image printed by ejecting ink under the same conditions as in the ejection recovery operation and with respect to the density of an image formed by printing after that. FIGS. 24A and 24B show a comparative example in which printing was performed without utilizing this embodiment. FIGS. 25A and 25*b* show an example in which printing was performed by utilizing this embodiment.

As in the case of the fourth embodiment, in the printing after the ejection recovery operation based on the construction of this embodiment, the visually discriminable permissible range with respect to density inconsistencies is wider even in the case of density inconsistencies generated through evaporation of the solvent. Further, in the case where color mixing is caused by wiping, it is not so conspicuous since it is caused by a lighter ink being mixed into a darker ink. Conversely, in the case of a light ink, density inconsistencies due to color mixing, etc. are very conspicuous.

(Sixth Embodiment)

Figure 26A:
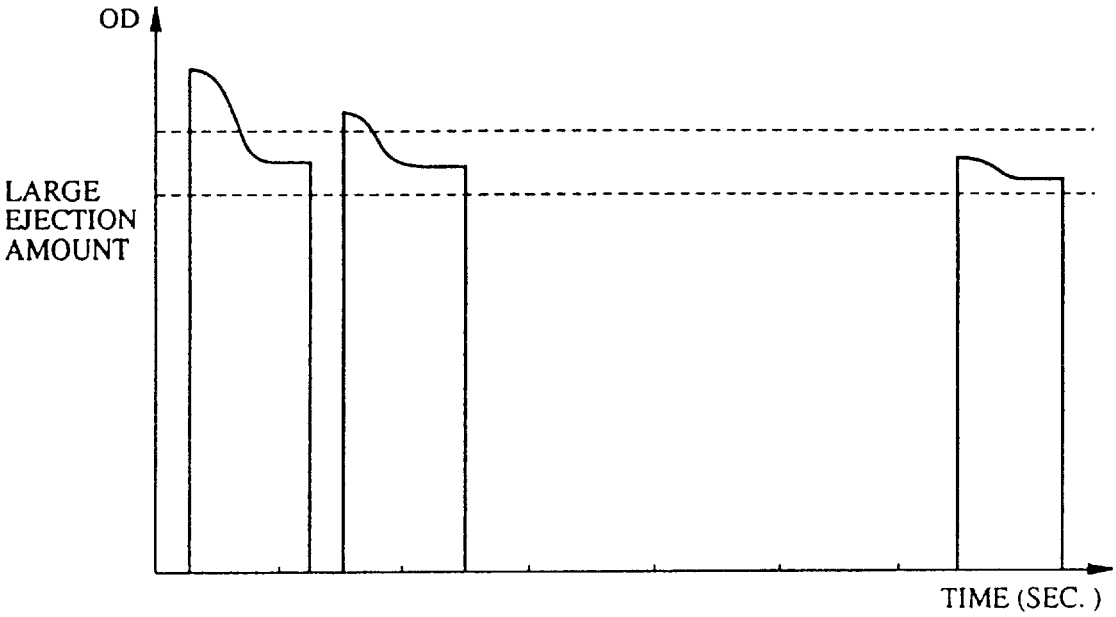
FIGS. 26A and 26B are charts showing the relationship between non-ejection time and density in two heads having different ejection amounts as in an embodiment when recovery is effected through preliminary ejection by a method not according to the present invention.
Figure 26B:
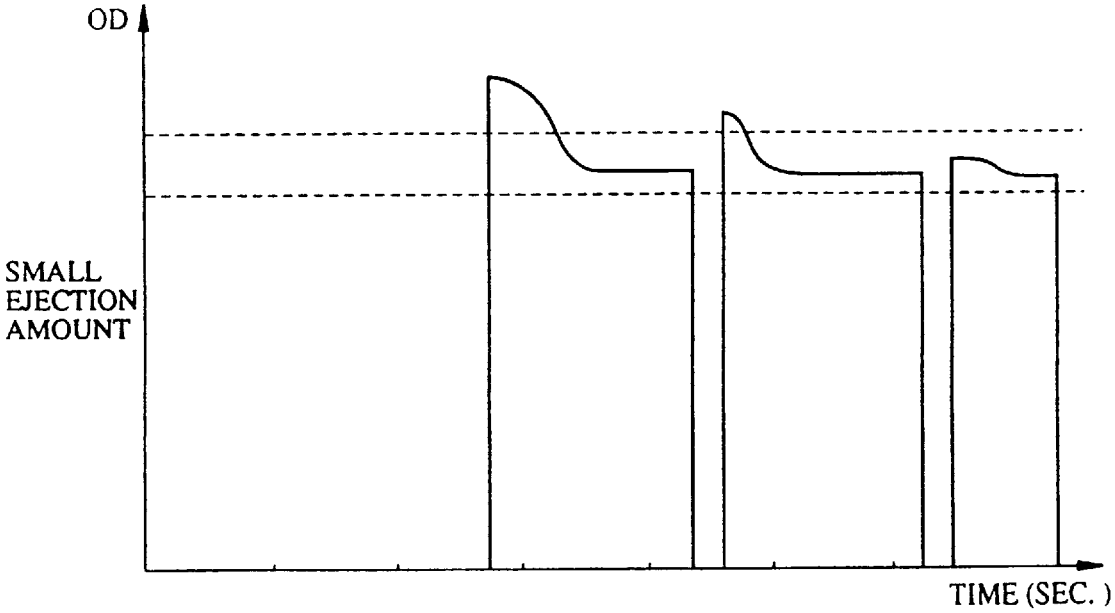
Figure 27A:
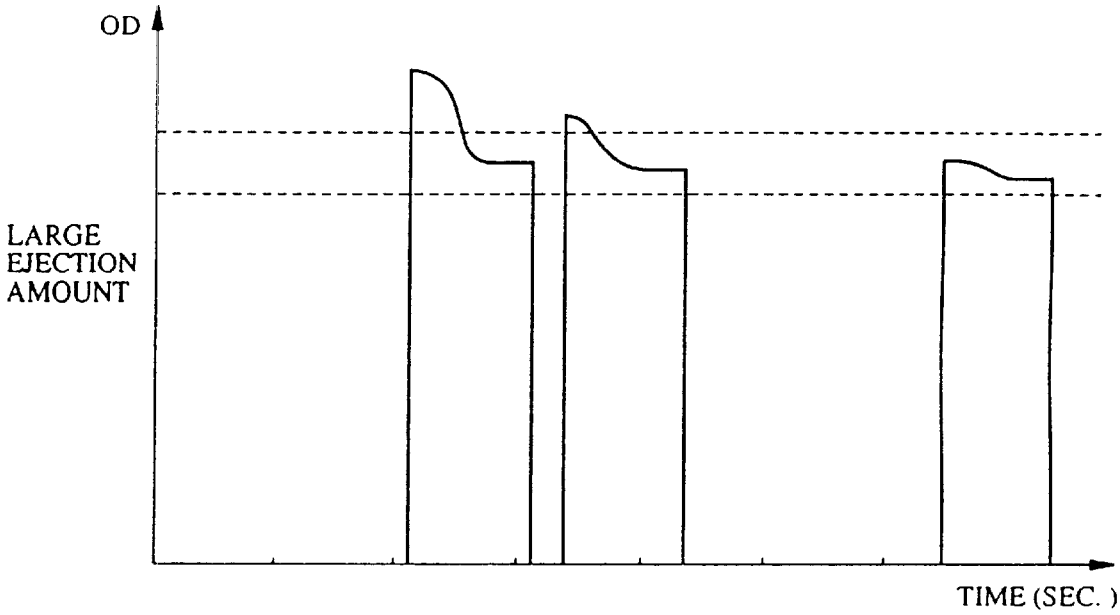
FIGS. 27A and 27B are charts showing the relationship between non-ejection time and density in a recording head when recovery is effected through preliminary ejection by a method according to the present invention.
Figure 27B:
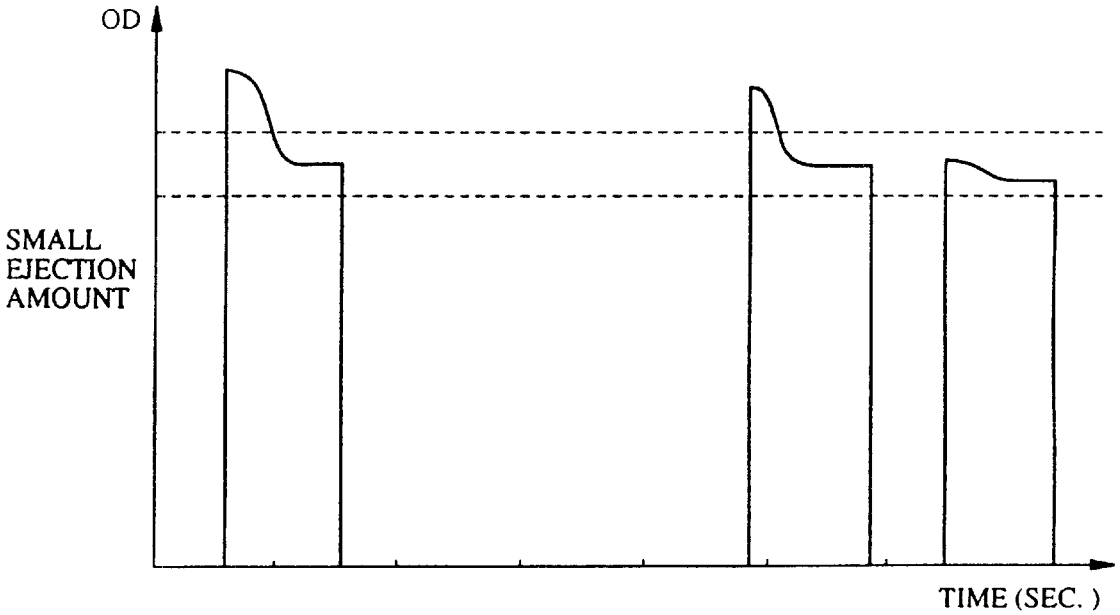

A sixth embodiment of the present invention will be described with reference to heads having the same structure and different ejection amounts. An experiment similar to that of the second embodiment was conducted. As to the outward appearance of this embodiment, it is similar to the one described with reference to the second embodiment. As shown in FIGS. 26A and 26B, in the case of such a construction, a head having a smaller ejection amount requires more time for ink discharge than a head having a larger ejection amount. As shown in FIGS. 27A and 27B, even with such a construction, it is possible, in accordance with the present invention, to minimize the requisite time for ink discharge and the amount of ink consumed by setting the interruption period relatively long for a head having a relatively small ejection amount than that for a head having a larger ejection amount.

In accordance with the present invention, the interruption period in the ink discharge process is set longer in the case of a light ink, which requires a relatively large amount of ink discharge for ink refreshment due to its tendency to exhibit conspicuous density inconsistencies, that in the case of a dark ink, whereby any concentrated ink, which causes density inconsistencies, is removed more efficiently, thereby making it possible to reduce the amount of ink consumed for ink refreshment.

A similar construction is also applicable to a head which has a relatively small ink discharge amount and from which ink is hard to discharge. By setting the pause between discharge operations relatively long for such a head, any dried and concentrated ink, which causes density inconsistencies, can be removed more efficiently than in the case of an ordinary discharge process, in which ink discharge is effected under the same conditions for all the heads, thereby making it possible to reduce the requisite time and the amount of ink consumed for ink refreshment.

What is claimed is:

1. An ink jet recording apparatus having a plurality of recording heads for respectively ejecting through discharge ports a plurality of inks of different lightness and a recovery mechanism for performing a recovery operation on a selected one of said plurality of recording heads by sucking ink through said discharge ports of said selected recording head, said apparatus comprising:

scanning means for moving each of said plurality of recording heads to a position facing said recovery mechanism, said recording heads being mounted on said scanning means;

selection means for selecting a recording head from said plurality of recording heads on which said recovery operation is to be performed;

recovery control means for controlling the recovery mechanism to perform said recovery operation successively on said plurality of recording heads in a descending order of ink lightness, wherein the recovery control means first instructs the selection means to select one of said plurality of recording heads which ejects ink of greater lightness, and then instructs the selection means to select one of said plurality of recording heads which ejects ink of less lightness;

ink ejection means for repeatedly ejecting ink from said discharge ports of said selected recording head; and ejection control means for controlling said ink ejection means so that the number of times that said ink ejection is to be effected from said selected recording head is according to the lightness of ink used by a preceding selected recording head on which said recovery operation has been performed, wherein said ejection control means controls the number of times said ink ejection is performed on any said recording head so that the lower the lightness of the ink used by said recording head, the smaller the number of times that said ink ejection is performed.

2. An ink jet recording apparatus according to claim 1, wherein said ejection control means controls the number of times said ink ejection is performed when the ejected ink is of least lightness and when the ejected ink is of greatest lightness so that the greater the lightness of the ink used by said preceding recording head on which said recovery operation has been performed, the smaller the number of times that said ink ejection is performed, and controls the number of times said ink ejection is performed so that for a given preceding recording head on which said recovery operation has been performed, the greater the lightness of the ejected ink, the greater the number of times that said ink ejection is performed.

3. An ink jet recording apparatus according to claim 1, wherein said recovery mechanism includes wiping means for wiping said discharge ports of said recording heads.

4. An ink jet recording apparatus according to claim 1, wherein said selection means selects said recording head on which said recovery operation is to be performed according to a length of a shutdown period during which said recording heads have not been operated.

5. An ink jet recording apparatus according to claim 1, wherein said recording heads include heat energy generating means for generating heat energy to eject ink from said discharge ports.

6. An ink jet recording apparatus having a plurality of recording heads for respectively ejecting through discharge ports a plurality of inks of different kinds and a recovery mechanism for performing a recovery operation on a selected one of said plurality of recording heads by sucking ink through said discharge ports of said selected recording head, said apparatus comprising:

scanning means for moving each of said plurality of recording heads to a position facing said recovery mechanism, said recording heads being mounted on said scanning means;

ink ejection means for repeatedly ejecting ink from said discharge ports of said selected recording head;

selection means for selecting a recording head from said plurality of recording heads on which said recovery operation is to be performed; and ejection control means for controlling said ink ejection means so that a number of times that ink is to be ejected from said selected recording head on which said recovery operation has been performed according to the kind of ink used by a preceding selected recording head on which said recovery operation has been performed, wherein said ejection control means controls the number of times ink ejection is performed when the ejected ink is of least lightness and when the ejected ink is of greatest lightness so that the greater the lightness of the ink used by said preceding selected recording head on which said recovery operation has been performed, the smaller the number of times that said ink ejection is performed, and controls the number of times said ink ejection is performed so that for a given preceding selected recording head on which said recovery operation has been performed, the greater the lightness of the ejected ink, the greater the number of times that said ink ejection is performed.

7. An ink jet recording apparatus according to claim 6, wherein said ejection control means controls the number of times said ink ejection is performed on any said selected recording head so that the lower a lightness of an ink used by said recording head, the smaller the number of times that said ink ejection is performed.

8. An ink jet recording apparatus according to claim 6, wherein said recovery mechanism includes wiping means for wiping said discharge ports of said recording heads.

9. An ink jet recording apparatus according to claim 6, wherein said selection means selects said recording head on which said recovery operation is to be effected according to a length of a shutdown period during which said recording heads have not been operated.

10. An ink jet recording apparatus according to claim 6, wherein said recording heads include heat energy generating means for generating heat energy to eject ink from said discharge ports.

11. A recording head recovery method for an ink jet recording apparatus having a plurality of recording heads for respectively ejecting through discharge ports a plurality of inks of different lightness, a recovery mechanism for performing a recovery operation on a selected one of said plurality of recording heads by sucking ink through said discharge ports of said selected recording head and an ink ejection mechanism for repeatedly ejecting ink from said discharge ports of said plurality of recording heads, said method comprising the steps of:

selecting a recording head, in accordance with the lightness of the ink ejected therefrom, on which said recovery operation is to be performed;

performing said recovery operation on successive selected recording heads in order of descending ink lightness and according to a length of a time during which said plurality of recording heads have not been operated, by bringing each of said plurality of recording heads successively to a position where each of said plurality of recording heads face said recovery mechanism; and ejecting ink from each said selected recording head a number of times according to a preceding selected said recording head on which said recovery operation has been performed in said performing step, wherein when the ejected ink is of least lightness and when the ejected ink is of greatest lightness, the greater the lightness of the ink used in said preceding selected recording head on which said recovery operation has been performed, the smaller the number of times that ink is ejected from a next recording head in said ejecting step, and for a given preceding selected recording head on which said recovery operation has been performed in said performing step, the greater the lightness of the ejected ink, the greater the number of times that ink is ejected from the next selected recording head in said ejecting step.

12. A recording head recovery method according to claim 11, wherein the lower the lightness of the ink used in said selected recording head from which ink is to be ejected, the smaller the number of times that ink is discharged in said ejecting step.

13. A recording head recovery method according to claim 11, wherein said recording heads include heat energy generating means for generating heat energy to eject ink from said discharge ports.

14. An ink jet recording apparatus using a plurality of recording heads for ejecting inks, each of said plurality of recording heads corresponding to one of a plurality of inks of different lightness, said apparatus comprising:

scanning means for moving the plurality of recording heads along a predetermined scanning direction;

a recovery mechanism for performing a recovery operation on one recording head by sucking ink through discharge ports of said recording head, said recovery mechanism including a cap portion for capping said discharge ports of said one recording head and negative pressure generating means for generating negative pressure in said cap portion, said cap portion being provided in a scanning range within which the plurality of recording heads are moved by said scanning means, and said cap portion being provided at a position where the plurality of recording heads moved by the scanning means are able to move in an opposite direction;

recovery control means for controlling said recovery mechanism to perform recovery operations on each of the plurality of recording heads, so that a recovery operation of each recording head is selectively effected from among the plurality of recording heads;

ink ejection means for repeatedly ejecting ink from discharge ports of a selected recording head; and ejection control means for controlling a number of times that said ink ejection is to be effected from the selected recording head according to a lightness of ink corresponding to a recording head on which said recovery operation has been previously performed, wherein said recovery operations are performed successively in a manner such that said recovery control means controls said scanning means to move each of the plurality of recording heads to an opposite position facing said cap portion in compliance with an order from the ink of greatest lightness to the ink of least lightness, wherein said recovery control means moves each of the plurality of recording heads to the opposite position of said cap portion in order by said scanning means; and wherein said ejection control means controls the number of times said ink ejection is to be effected so that the greater the lightness of the ink used by the recording head on which said recovery operation has been previously performed, the smaller the number of times that said ink ejection is to be effected, and controls the number of times said ink ejection is to be effected so that for a given recording head on which said recovery operation has been previously performed, the greater the lightness of the ejected ink, the greater the number of times that said ink ejection is to be effected.

15. An ink jet recording apparatus using a plurality of recording heads for ejecting inks, each of said plurality of recording heads corresponding to one of a plurality of inks of different lightness, said apparatus comprising:

scanning means for moving the plurality of recording heads along a predetermined scanning direction;

a recovery mechanism for performing a recovery operation on one recording head by sucking ink through discharge ports of said recording head, said recovery mechanism including a cap portion for capping said discharge ports of said one recording head and negative pressure generating means for generating negative pressure in said cap portion, said cap portion being provided in a scanning range within which the plurality of recording heads are moved by said scanning means, and said cap portion being provided at a position where the plurality of recording heads moved by the scanning means are able to move in an opposite direction;

recovery control means for controlling said recovery mechanism to perform recovery operations on each of the plurality of recording heads, so that a recovery operation of each recording head is selectively effected from among the plurality of recording heads;

ink ejection means for repeatedly ejecting ink from discharge ports of a selected recording head; and ejection control means for controlling a number of times that said ink ejection is to be effected from the selected recording head according to a lightness of ink corresponding to a recording head on which said recovery operation has been previously performed, wherein said recovery operations are performed successively in a manner such that said recovery control means controls said scanning means to move each of the plurality of recording heads to an opposite position facing said cap portion in compliance with an order from the ink of greatest lightness to the ink of least lightness, wherein said recovery control means moves each of the plurality of recording heads to the opposite position of said cap portion in order by said scanning means; and wherein said ejection control means controls the number of times said ink ejection is to be effected on any said recording head so that the lower the lightness of the ink used by said recording head, the smaller the number of times that said ink ejection is to be effected.

16. A recovery control method in an ink jet recording apparatus using a plurality of recording heads, said apparatus having scanning means for moving said plurality of recording heads along a predetermined scanning direction, a cap portion for capping discharge ports of a recording head, said cap portion being provided in a scanning range within which said plurality of recording heads are moved by said scanning means and said cap portion being provided at a position where said plurality of recording heads moved by the scanning means are able to move in an opposite direction, and negative pressure generating means for generating negative pressure in said cap portion, said method comprising the steps of:

scanning said plurality of recording heads in a manner such that one of said plurality of recording heads is moved to an opposite position facing said cap portion;

sucking ink through discharge ports of said one recording head by generating negative pressure in said cap portion using said negative pressure generating means; and controlling said scanning step and said sucking step to be performed for said plurality of recording heads in compliance with an order from the ink of greatest lightness to the ink of least lightness, wherein the controlling step controls said scanning step and said sucking step to be selectively performed on each recording head of said plurality of recording heads by moving each of the plurality of recording heads to the opposite position of said cap portion in order by said scanning means, wherein the controlling step controls a number of times that ink ejection is to be effected from the selected recording head according to the lightness of ink corresponding to a recording head on which said recovery operation has been previously performed, and wherein the controlling step controls the number of times said ink ejection is to be effected so that the greater the lightness of the ink used by the recording head on which said recovery operation has been previously performed, the smaller the number of times that said ink ejection is to be effected, and the number of times said ink ejection is to be effected is controlled so that for a given recording head on which said recovery operation has been previously performed, the greater the lightness of the ejected ink, the greater the number of times that said ink ejection is to be effected.

17. A recovery control method in an ink jet recording apparatus using a plurality of recording heads, said apparatus having scanning means for moving said plurality of recording heads along a predetermined scanning direction, a cap portion for capping discharge ports of a recording head, said cap portion being provided in a scanning range within which said plurality of recording heads are moved by said scanning means and said cap portion being provided at a position where said plurality of recording heads moved by the scanning means are able to move in an opposite direction, and negative pressure generating means for generating negative pressure in said cap portion, said method comprising the steps of:

scanning said plurality of recording heads in a manner such that one of said plurality of recording heads is moved to an opposite position facing said cap portion;

sucking ink through discharge ports of said one recording head by generating negative pressure in said cap portion using said negative pressure generating means; and controlling said scanning step and said sucking step to be performed for said plurality of recording heads in compliance with an order from the ink of greatest lightness to the ink of least lightness, wherein the controlling step controls said scanning step and said sucking step to be selectively performed on each recording head of said plurality of recording heads by moving each of the plurality of recording heads to the opposite position of said cap portion in order by said scanning means, wherein the controlling step controls a number of times that ink ejection is to be effected from the selected recording head according to the lightness of ink corresponding to a recording head on which said recovery operation has been previously performed, and wherein the controlling step controls the number of times said ink ejection is to be effected on any said recording head so that the lower the lightness of the ink used by said recording head, the smaller the number of times that said ink ejection is to be effected.

* * * * *

UNITED STATES PATENT AND TRADEMARK OFFICE

CERTIFICATE OF CORRECTION

PATENT NO. : 6,527,361 B1
DATED : March 4, 2003
INVENTOR(S) : Gotoh et al.

It is certified that error appears in the above-identified patent and that said Letters Patent is hereby corrected as shown below:

Column 4,
Line 50, “the” should be deleted.

Column 16,
Line 1, “respected” should read -- respect --; and
Line 38, “that” should read -- that is --.

Signed and Sealed this

Twenty-fifth Day of November, 2003

JAMES E. ROGAN
*Director of the United States Patent and Trademark Office*